US009879854B2

(12) United States Patent
Masterson et al.

(10) Patent No.: US 9,879,854 B2
(45) Date of Patent: Jan. 30, 2018

(54) FUEL AND A FUEL BURNING SYSTEM AND METHOD

(71) Applicant: Masterson Enterprises, Inc., Addison, IL (US)

(72) Inventors: Daniel J. Masterson, Geneva, IL (US); Dipan Surati, Des Plaines, IL (US)

(73) Assignee: Masterson Enterprises, Inc., Glendale Heights, IL (US)

( * ) Notice: Subject to any disclaimer, the term of this patent is extended or adjusted under 35 U.S.C. 154(b) by 959 days.

(21) Appl. No.: 14/070,300

(22) Filed: Nov. 1, 2013

(65) Prior Publication Data

US 2014/0134546 A1 May 15, 2014

Related U.S. Application Data

(63) Continuation of application No. 13/868,966, filed on Apr. 23, 2013, now abandoned.

(60) Provisional application No. 61/687,368, filed on Apr. 25, 2012, provisional application No. 61/687,248, filed on Apr. 23, 2012, provisional application No. 61/687,352, filed on Apr. 24, 2012, provisional application No. 61/688,750, filed on May 22, 2012.

(51) Int. Cl.

| | |
|---|---|
| ***F23D 5/02*** | (2006.01) |
| ***F23D 3/18*** | (2006.01) |
| ***F23D 3/08*** | (2006.01) |
| ***F23D 5/04*** | (2006.01) |
| ***F23D 3/16*** | (2006.01) |

(52) U.S. Cl.

CPC ..... *F23D 3/18* (2013.01); *F23D 3/08* (2013.01); *F23D 3/16* (2013.01); *F23D 5/04* (2013.01)

(58) Field of Classification Search

CPC ..... F23D 3/18; F23D 3/24
USPC ..... 431/292, 302, 303
See application file for complete search history.

(56) References Cited

U.S. PATENT DOCUMENTS

| | | | |
|---|---|---|---|
| 1,327,048 | A | 1/1920 | Kinealy |
| 2,622,017 | A | 2/1949 | Bramhall et al. |
| 3,428,409 | A | 2/1969 | Summers |
| 5,840,246 | A | 11/1998 | Hammons et al. |
| 6,371,756 | B1 | 4/2002 | Toohey |
| 6,857,869 | B1 | 2/2005 | Sun |

(Continued)

FOREIGN PATENT DOCUMENTS

| | | | | |
|---|---|---|---|---|
| WO | 2009152502 | A1 | 12/2009 | |
| WO | 2009152504 | A1 | 12/2009 | |
| WO | WO 2009152504 | A1 * | 12/2009 | ..... F23D 3/18 |

*Primary Examiner* — Jason Lau
(74) *Attorney, Agent, or Firm* — Erickson Law Group, PC

(57) ABSTRACT

A method of fueling a flame, a fuel, and a fuel burning system is provided. The system has a melted wax reservoir, a fuel, a melting grate, and a wick. The fuel has a body, a priming section, a front wall, and a bottom surface. The priming section is vertically spaced from the bottom surface and extending from the front wall to create an overhang. The priming section extends along less than the entire length of the front wall. The melting grate is configured to support the fuel. The melting grate extends above the melted wax reservoir so that fuel melted on the melting grate can be received into the melted wax reservoir. The wick has an at least partially hollow core forming a burn chamber extending above the melting grate. The fuel is configured to be positioned so the overhang is located over or adjacent to the wick.

19 Claims, 21 Drawing Sheets

(56) References Cited

U.S. PATENT DOCUMENTS

| | | | | |
|---|---|---|---|---|
| 2003/0086815 | A1 | 5/2003 | Wesley | |
| 2006/0057521 | A1 | 3/2006 | Kubicek et al. | |
| 2007/0264603 | A1 | 11/2007 | Ruff | |
| 2013/0115565 | A1 * | 5/2013 | Masterson | F23D 3/18<br>431/292 |

* cited by examiner

FUEL AND A FUEL BURNING SYSTEM AND METHOD

This application is a continuation of U.S. patent application Ser. No. 13/868,966, filed Apr. 23, 2013, which claimed the benefit of U.S. Patent Application No. 61/687,368, filed on Apr. 25, 2012, and U.S. Patent Application No. 61/687,248, filed on Apr. 23, 2012, and U.S. Patent Application No. 61/687,352, filed on Apr. 24, 2012, and U.S. Patent Application No. 61/688,750, filed on May 22, 2012, each naming Daniel J. Masterson as an inventor, and each application above is incorporated herein by reference in its entirety.

FIELD OF THE INVENTION

The invention relates to fuel burners and more specifically systems for burning solid fuels.

BACKGROUND OF THE INVENTION

Typically wax is used as a fuel in traditional candles. Traditional candles transfer heat to melt the wax around a wick via radiation. The process delivers heat slowly and inefficiently resulting in a slow rate of melting the wax around the wick and creating the melt pool. Performance candles, candles that are used to drive a volatile active ingredient into the air, rely on developing a melt pool since the rate of active delivery is dependent on the size or surface area of the pool. Traditional candles can take four or more hours to create a melt pool of sufficient size to fill a typical room or area with its volatile active ingredient.

At the same time, because the flame size is limited and the resulting heat flux generated by the flame so small, the operating temperature of a candle melt pool is barely above the melt temperature of the wax, which limits the rate and the completeness of the volatile chemical delivery and limits the pallet of active ingredients that can be functional to those that work at lower temperatures.

Because of the small flame, slow melt pool development, and low operating temperature of the melt pool, performance candles suffer from sluggish and incomplete delivery. Performance candle formulators (like perfumers) are restricted to a limited breadth of ingredients that can be effectively used.

Further, traditional candles have flame sizes that are greatly limited. Candles used indoors are limited in size and in heat of the flame due to the creation of soot as the candle/wick system increases in size. As such products move outdoors, where soot can be accommodated, larger flames become increasingly difficult to create because larger wicks become difficult to ignite. This is due to the overall mass and heat capacity of the wick and wax, which makes it difficult or impossible to vaporize the fuel for ignition.

Indoor or traditional candle type products are therefore limited in flame size and heat delivery. The indoor use of candles can be used for lighting as well as delivery of a volatile active ingredient like fragrance, medicinal ingredients, or insect repellent (if used outdoors). Unfortunately, the flame size and heat limitations of the traditional wick and wax systems result in products that create low light and take exceptionally long times for the melt pool to develop. Since the active delivery is a function of both the wax/fuel melt pool size and operating temperature, the volatile active ingredient is slow to release and to be delivered to the surroundings. Even the Glade™ Scented Oil Candle that uses metal fins within the flame takes almost an hour to create a melt pool. In the outdoor use environment, this melt pool issue is exacerbated because of cooler air temperatures or the cooling effects of breezes.

Outdoor products rely on more flammable fuels like mineral oils or alcohols. Alcohol fuels like ethanol, isopropyl alcohol, and other short chain alcohols have recently been recalled due to their extreme flammability and ability to carry the fire without a wick. Mineral oil type fuels, like those used in yard torches, are acutely toxic to the respiratory system upon even the slightest ingestion. In addition, the liquid fuels are prone to creating excessive soot and develop and deliver an oil refinery off odor.

The present inventor has recognized that waxes, including but not limited to paraffin, soy wax, palm wax, beeswax, and others, would make ideal fuels, especially for outdoor products that desire and require larger flames. Additionally, the present inventor has recognized that indoor applications could benefit from both light intensity improvements as well as faster wax pool development. The present inventor recognizes the need for a device that allows for faster wax pool melting and increased heat production.

Still Further, wicks or wick material often function as a filter and, like filters, are prone to fouling or clogging resulting from prolonged use or use with "dirty" filtrate (or fuel in the case of wicks). Most wicks are consumable and are not plagued by fouling or clogging; yet the phenomenon presents itself and can be dangerous as carbon pills form at the end of consumable wicks. The present inventor has recognized that the benefits of a reusable or permanent wick are many and varied and include, but are not limited to, flame control, flame staging, and, in some applications, creating flames of unique geometry, hotter flames, larger stable flames, and less soot. However, reusable wicks are prone to clogging or fouling by the fuel used—especially fuels that contain higher levels of longer chain hydrocarbons (products like waxes or paraffin). These kinds of fuel with repeated use can lead to build-up of varnish, tar, carbon deposits, and other materials that can prevent the liquid fuel from flowing through the wick material, which results in diminished performance (smaller flames) and ultimately complete failure. In effect, the chemical nature of hydrocarbon fuels and their natural inclusion of longer chain components (even at very low levels) has heretofore made using permanent or reusable wicks difficult or practically impossible.

The present inventor has recognized the need for a device that allows reusable or permanent wicks while diminishing or eliminating the cumulative effects of fouling or clogging caused by hydrocarbon fuels.

Moreover, the present inventor has recognized that unlike traditional candles with a consumable wick, reusable and permanent wick candles offer the user the option to make larger and more stable flames, to create wax burners that shed more light, to create candles that produce larger and warmer melt pools that in turn more effectively deliver a volatile ingredient to the environment, and to repeatedly operate the system with no waste.

However, since the reusable or permanent wick remains with the burner apparatus, consideration is needed for preparing the wick for reuse. The present inventor has recognized that when the wick is barren of any fuel, it may require priming. The present inventor has recognized that priming must be enough to allow easy ignition without taking too long to ignite or without flooding the point of ignition. Then that first ignition point must provide enough heat to the surrounding wax to stoke the developing flame without melting so much wax that the melted wax restricts or even douses the developing flame. The present inventor has recognized that an imbalance of both the priming and stoking stages of the developing flame can result in starving the flame or in partially or completely flooding the first ignition.

The present inventor has recognized the need for a solid fuel, such as solid wax structure that repeatedly and reliably offers a natural priming location for wick ignition and then automatically manages the stoking stage to allow uninhibited and full development of the desired flame. Finally, the present inventor recognized the need for a device that provides a main wax portion that is to be melted by the flame and used through complete melt and combustion.

SUMMARY OF THE INVENTION

A method of fueling a flame, a fuel for a fuel burning system and a fuel burning system are disclosed. In some embodiments, the method of fueling a flame comprises the steps of locating a solid fuel on a melting grate adjacent to a wick. The wick has a core that is at least partially hollow. The solid fuel has a priming section. The priming section is positioned adjacent to or on the wick. At least a portion of the priming section is heated with an ignition source so that at least a portion of the priming section melts and falls onto the wick. The wick is ignited when the wick comprises a sufficient amount of fuel to support a flame on the wick.

In an aspect of the method, after the wick is ignited the remaining priming section is melted with a heat from the flame on the wick. Then a stoking section of the solid fuel is melted and the melted fuel is drawn into the wick from a lower portion of the wick to fuel the flame on an upper portion of the wick. Then a main section of the solid fuel is melted with a heat from the flame on the wick, by transferring heat to the main section through the melting grate and drawing the melted fuel into the wick to fuel the flame.

In some embodiments, heating the priming section comprises heating at least a portion of the priming section with the ignition source so that a portion of the priming section melts and falls onto a side of the wick.

In some embodiments, heating the priming section comprises heating at least a portion of the priming section with the ignition source so that a portion of the priming section melts and falls on a top surface of the wick.

In some embodiments, heating the priming section comprises heating at least a portion of the priming section with the ignition source so that a portion of the priming section melts and falls onto the wick without flooding the wick.

In some embodiments, a base of the solid fuel is placed on the melting grate so that the priming section of the solid fuel extends over at least a portion of the wick.

In some embodiments, heating the priming section comprises flowing a portion of the priming section along a primary flow path of the priming section towards the wick.

In some embodiments, heating the priming section comprises flowing a portion of the priming section along a primary flow path of the priming section towards the ignition source.

In some embodiments, melted fuel flows from the stoking section away from the flame and toward the side or bottom of the wick to be absorbed in the wick to fuel the flame on the wick.

In some embodiments, melted fuel from the main section of the solid fuel flows toward the bottom of the wick to continuously replenish the wick with fuel.

In some embodiments, the flame on the wick is maintained with fuel flowed from a main section of the solid fuel until the main section of the solid fuel is exhausted.

In some embodiments, a portion of the solid fuel adjacent the flame is melted so that an unmelted mass of the solid fuel falls toward the flame.

A fuel for a fuel burning system having a wick is disclosed. In some embodiments, the fuel comprises a body comprising wax, a priming section, a front wall, and a bottom surface. The priming section is vertically spaced from the bottom surface and extends from the front wall to create an overhang. The priming section extends along less than an entire length of the front wall.

In some embodiments, the body comprises at least one of a fragrance, an insect repellent, or a medicinal ingredient.

In some embodiments, the body comprises a stoking section adjacent a main section. The stoking section has a mass that is less than a mass of the main section. The priming section has a mass that is less than the mass of the stoking section and less than the mass of the main section.

In some embodiments, the priming section is configured to prime ignition of an at least partially hollow core wick. The stoking section is configured to stoke a flame. The main section is configured to maintain the flame until substantially all of the fuel is consumed.

In some embodiments, the priming section has a mass to support ignition and maintain a flame on the wick when the ignition source is removed and to cause initial melting of a stoking section of the body. In some embodiments, the priming section has a mass of 0.5 grams or less.

In some embodiments, the body has a stoking section. The stoking section has a mass sized to fuel a flame as the flame develops on the wick and an operating temperature of a wick assembly is elevated by the flame above a melting temperature of a main section of the fuel. In some embodiments, the mass of the stoking section is greater than 0.24 grams and less than 3 grams.

In some embodiments, the fuel has a body comprising wax, a front wall, and a bottom surface. The front wall is configured to face an at least partially hollow core wick. The body has a center of gravity biased in a direction of the front wall.

In some embodiments, the body of the fuel has an angle of incidence that is greater than the angle of list and less than or equal to 90 degrees. In some embodiments, the body comprises at least two arms configured to space the body a predefined distance from a wick.

A fuel burning system for burning the aforementioned fuel is disclosed, comprising: a melted wax reservoir, a fuel, a melting grate, and a wick. The fuel comprising a body, a priming section, a front wall, and a bottom surface. The priming section is vertically spaced from the bottom surface and extending from the front wall to create an overhang. The priming section extends along less than the entire length of the front wall. The melting grate is configured to support the fuel. The melting grate extends above the melted wax reservoir so that fuel melted on the melting grate can be received into the melted wax reservoir. The wick has an at least partially hollow core forming a burn chamber extending above the melting grate. The fuel is configured to be positioned so that the overhang is positioned over or adjacent to the wick.

Numerous other advantages and features of the present invention will become readily apparent from the following detailed description of the invention and the embodiments thereof, from the claims and from the accompanying drawings.

DETAILED DESCRIPTION

Figure 1:
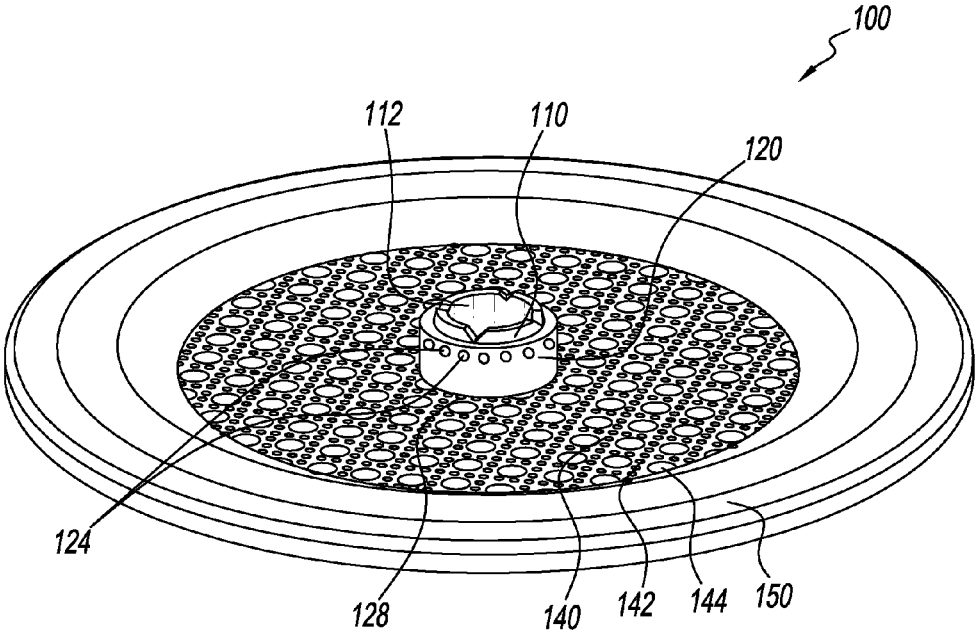
FIG. 1 is a perspective view of one embodiment of a fuel burning system of the invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

Figure 2:
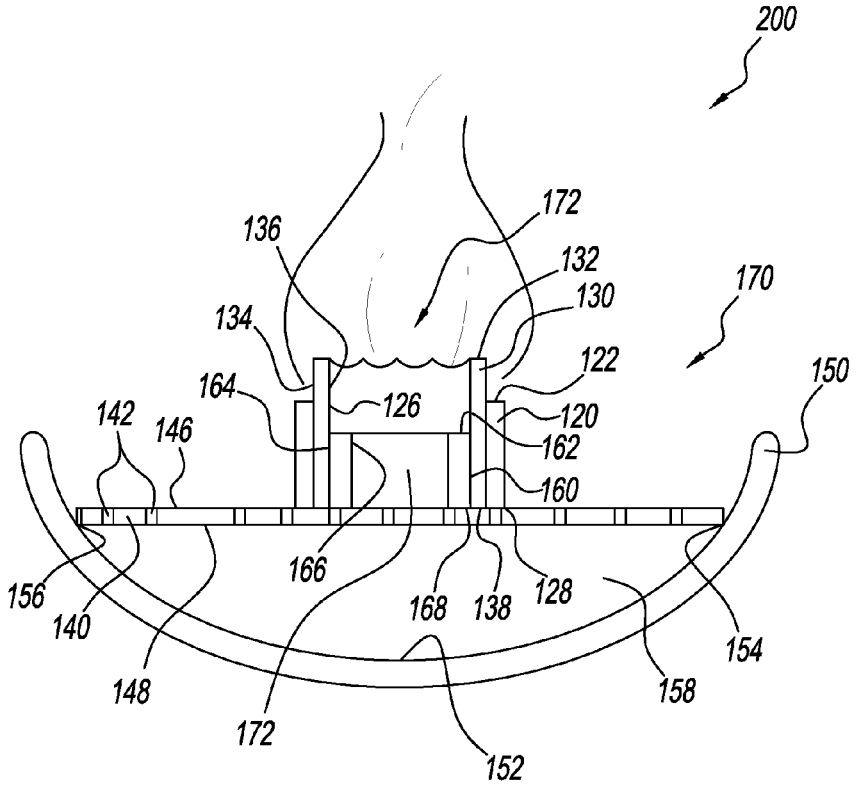
FIG. 2 is a sectional side view of a second embodiment of a fuel burning system of the invention.
Figure 3:
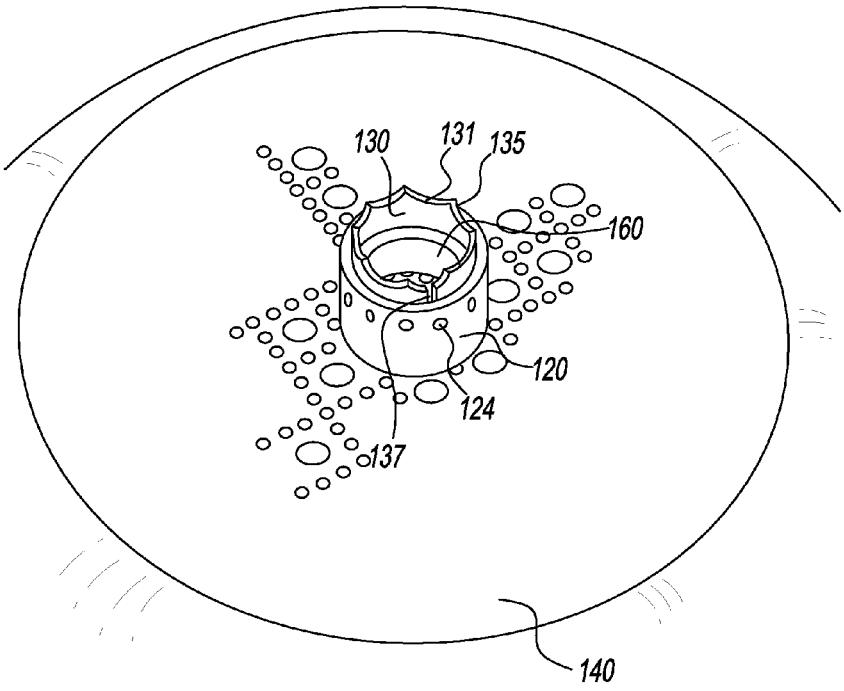
FIG. 3 is a perspective view of the fuel burning system of FIG. 2 with certain components not shown.

System Overview. FIG. 1 shows an embodiment of a solid fuel burner system 100. The burner system 100 comprises a hollow-core wick 110, a burn chamber 112, a wick sheath 120, a melting grate 140, and a fuel reservoir 150, such as a bowl or basin. FIGS. 2-3 show an embodiment of the burner system 100 of FIG. 1 with an alternative embodiment hollow-core wick 130 and an inner wick support ring 160. The hollow-core wick 130 of FIGS. 2-3 is substituted for the hollow-core wick 110 of FIG. 1.

In general operation, a solid fuel, such as solid fuel 201, is placed on the melting grate. The wick is lit and the resulting flame begins to heat the solid fuel causing it to melt. The melted fuel flows through the melting grate and into the fuel reservoir. The melted fuel is drawn into the wick to continue fueling the flame at the wick. The flame transmits heat to the solid fuel in at least two ways. First, heat from the flame is transmitted through the ambient air to the solid fuel. Second, heat is thermally transferred through the wick sheath and the melting grate to the fuel which is in contact with the melting grate. In some arrangements, wax may fall directly on the wick to prime the wick during initial operation until fuel is drawn into a bottom portion of the wick for feeding the flame at the top of the wick.

The reservoir 150 comprises a curved shape having a bottom 152 with upwardly curving sides 154, 156. The width of the melting grate 140 is sized to contact the sides 154, 156 of the bowl to position the bottom 148 of the melting grate 140 a pre-defined distance from the bottom of the reservoir. The volume of space between the bottom 152 of the reservoir 150 and the bottom 148 of the melting grate 140 is the lower fuel reservoir area 158.

The melting grate is suspended above at least the lower most portion of the bottom 152 of the reservoir 150. The bowl or basin may comprise other shapes other than curved, for example the bottom may be flat with obliquely angled side walls for intersecting with the melting grate. The top 146 of the melting grate establishes a support surface for the wick system 170 and for solid fuel 201. Melting grate comprises a plurality of holes 142, 144 that allow melted fuel, such as melted wax to travel from the top surface of the melting grate down into the reservoir. The holes may be different sizes as that there are larger holes 144 and smaller holes 142. The wick system 170 comprises a wick, such as wick 110 or 130, the wick sheath 120, and optionally the wick support ring 160. The wick system 170 creates a burn chamber 172 within the hollow-core wick 130 and bounded by the wick sheath.

The hollow-core wick 130 has an upper surface 132 and a lower surface 138. The upper surface 132 of the wick may comprise a plurality of peaks 135 and valleys 131. The wick sheath has an upper surface 122, and a lower surface 128. The wick support ring 160 has an upper surface 162 and a lower surface 168. The lower surfaces 168, 138, 128 of each of the wick support ring 160, the wick 130, and the wick sheath 120 are supported on the upper surface of the melting grate 140. The wick system 170 may be placed on the melting grate in any particular location. In some embodiments, the wick system is centered on the melting grate. In some embodiments, the melting grate is 4.25 inches in diameter, but many other sizes are also possible. Each of the wick sheath 120, the wick 130, and the wick support ring 160 comprises a cylindrical shape, however, in some embodiments, each may comprise other shapes such as such a shown and described in FIGS. 18-22.

In some embodiments, the inside surface 126 of the wick sheath 120 is in contact with the outside surface of the wick 130 and the inside surface 136 of the wick 130 is in contact with the outside surface of the wick support ring 160. In some embodiments, the inside surface 126 of the wick sheath 120 is in close proximity but not in surface-to-surface contact with the outside surface of the wick 130 and the inside surface 136 of the wick is in close proximity with the outside surface of the wick support ring 160. The close proximity may comprise distances in the range of about 0.001 of an millimeters to about 5 millimeters. In the embodiment shown in FIG. 2, the wick support ring is shorter than the wick sheath, which is shorter than the wick.

In some embodiments, a melting plate replaces the melting grate. The melting plate does not have any holes and the wick 130 is fed through lower holes (not shown) in the wick sheath.

In some embodiments, the reservoir is arranged to be positioned relatively close to the wick system to promote fast melt pool creation. The shape of the reservoir allows for a falling of melted wax toward the flame. The wax systematically melts from heat conduction, typically from the melting grate or a plate supporting the wick system. This is done by creating a shape that shifts the center of gravity of the melted wax toward the wick system as the wax melts.

Wick Sheath Apertures. The wick sheath comprises a plurality of air intake apertures or holes 124. The holes 124 are spaced apart about the circumference of the wick sheath. The holes are located adjacent to the upper surface 122 of the wick sheath 120. In some embodiments, the holes are located in the top half or top quarter of the height of the wick sheath. In some embodiments, the holes are 0.06 inches in diameter and allow air into the burn chamber. The holes 124 allow air to be pulled through the porous wick and into the burn chamber. The air intake holes allow an increased amount of oxygen to be introduced into the burn system thereby resulting in a higher burning/operating temperature.

The number and size of air intake holes 124 in the wick sheath affects the burn performance of the wick system 170. For example, the flame can be reduced by utilizing fewer holes or no holes, thereby reducing or starving the combustion of oxygen. On the other end of the spectrum, if the number and/or size of the holes are too great, too much oxygen will be allowed and the flame will be too large for its intended use. The number of holes will affect the stoichiometry of the combustion, generally by using oxygen as the limiting reactant to make larger, soot free, stable flames. Finally, if the holes are too large and expose too much of the porous wick material, the exposed side of the wick at the hole could ignite. In some embodiments, it is preferred that the holes be less than ⅛ of an inch in diameter. In some embodiments, it is further preferred that the holes be less 1/16 inch in diameter. In one embodiment, the wick sheath comprises at between 2 and 10 apertures spaced apart equally about the circumferential outer side wall of the wick sheath.

In some embodiments, the wick sheath may comprise non-porous material such as metal, such as aluminum, copper, steel, iron, nickel, or a combination thereof. In some embodiments, the wick sheath may a comprise material that has a lesser heat conductivity than metal but will survive a flame, such as ceramic, stone, refractory materials, glass, or a combination thereof. The inner wick support ring may comprise the same types of material just described for the wick sheath. The wick support ring is optional and is provided to maintain the shape of upstanding the wick adjacent or against the wick sheath. Some wick materials do not require a wick support ring for maintaining the wick's shape. The reservoir 150 may comprise wood, glass, ceramic, metal, and high melting resin. In some embodiments, the wick is comprised of ceramic fiber paper, such as Fiberfrax® Ceramic Paper 970A manufactured by Unifrax LLC of Niagara Falls, N.Y. In some embodiments, the wick is comprised of one or more of ceramic fiber paper, sintered glass, porous metals, porous ceramics, porous rock, metal weave, fiberglass, and carbon composite.

Starter Wick.

Figure 4:
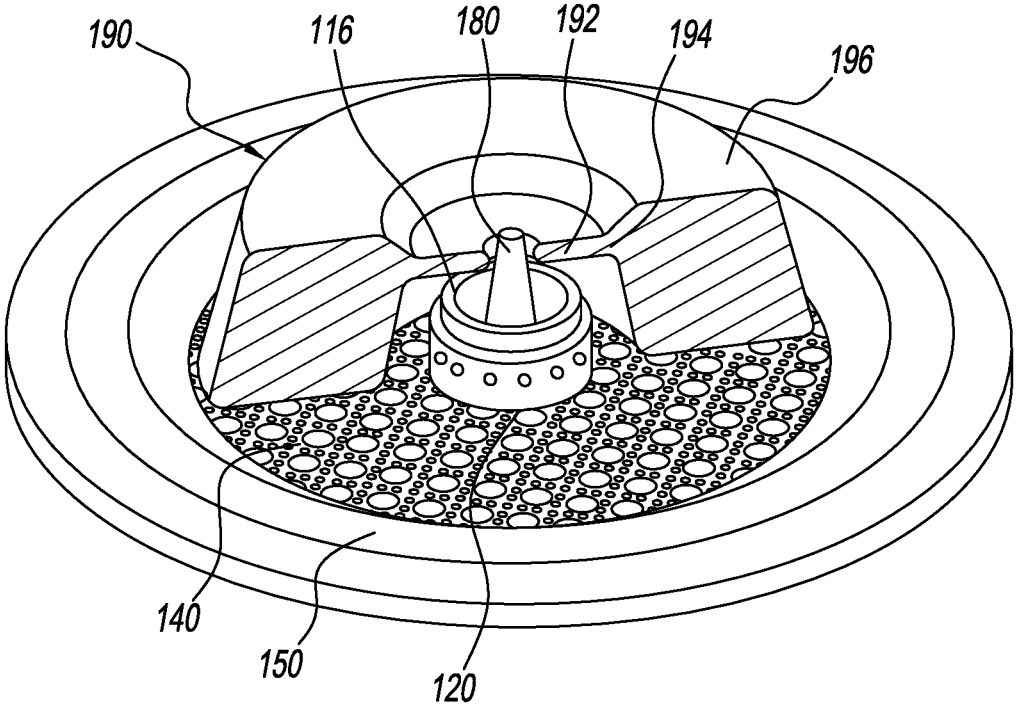
FIG. 4 is a perspective view of a third embodiment of a fuel burning system of the invention.
Figure 5:
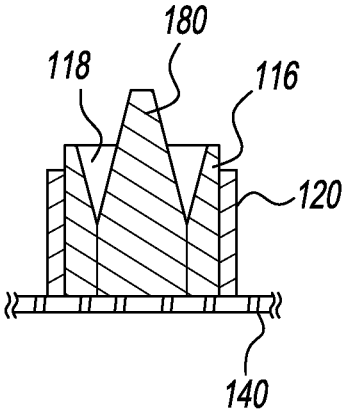
FIG. 5 is a sectional side view of a hollow core wick, a priming wick, a wick sheath, and a portion of a melting grate from FIG. 4.

In some embodiments, the burner system 100, 200 includes a starter wick 180 as shown in FIGS. 4 and 5. FIG. 4 shows another embodiment of a hollow core wick 116. The starter wick 180 has a diameter that is smaller than the hollow core-wick. The smaller diameter of the starter wick reduces the total thermal mass or total heat capacity of the combination of the hollow-core wick and the starter wick at a point where ignition is useful. It is preferred to have the starter wick 180 at the center of the hollow-core wick. The location of the starter wick 180 can be anywhere where the transition of the flame to the ultimate hollow-core wick 116 can be accomplished. FIG. 5 shows that the exterior surface of the starter wick is in surface-to-surface contact with an interior surface of the hollow core wick. In some embodiments, the starter wick is not in surface to surface contact with the hollow core wick, but is within 0.5 inches of the closest surface of the larger hollow core wick 116.

Wickless Solid Fuel.

The burner system 100, 200 utilizes a solid fuel 190, 201. The solid fuel may be of a configuration as disclosed in U.S. patent application Ser. No. 13/640,478. U.S. patent application Ser. No. 13/640,478 is herein incorporated by reference in its entirety to the extent not inconsistent with the present disclosure. The solid fuel can be in either a pellet form or a pre-formed solid element such as shown in FIG. 4.

The solid fuel used by the system may be comprised of solid wax fuels, such as soy wax, palm wax, beeswax, paraffin, or other hydrocarbon fuels that are solid below 90 Fahrenheit (F) and liquid above 220 F. More particularly, the solid fuel waxes used by the system may comprise those that melt when heated to temperatures in the ranges of 125 F to 180 F. The fuels usable with the burner system include not only solid fuels but also liquid fuels. Therefore, the fuel used can be any meltable solid or liquid hydrocarbon or glycol whose flash point is in excess of 180 F. Such fuels may include soy wax, palm wax, solid paraffin, liquid paraffin, olive oil, diethylene glycol, monoethylene glycol, among others.

In one embodiment, the solid fuel 190 has a priming section 192, a stoking section 194, and a main section 196 as shown in FIG. 4. The priming section is located adjacent to the hollow core wick 116 and the starter wick 180. The priming section has a thickness that is sufficiently small to allow for quick melting to prime the wicks 116,180. The stoking section 194 is sized to bridge the fueling of the wicks 116, 180 until the main section 196 is sufficiently heated to deliver melted fuel for fueling the wick.

Figure 6:
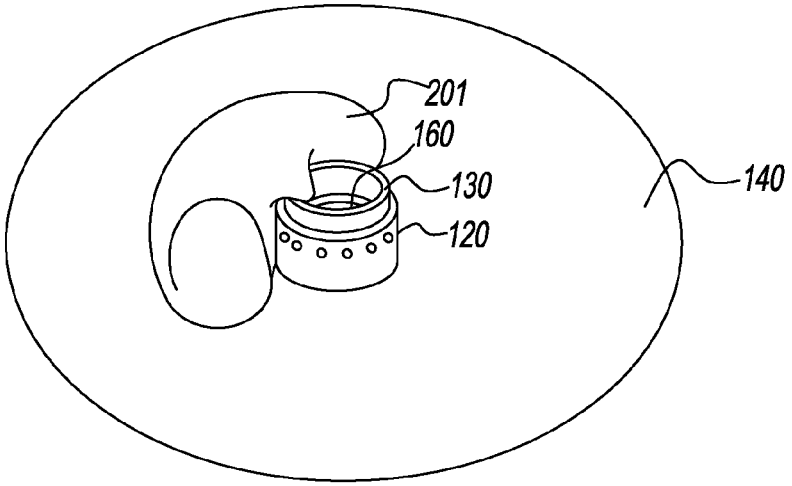
FIG. 6 is a perspective view of a portion of the fuel burning system of FIG. 2 with a second embodiment solid fuel.
Figure 7:
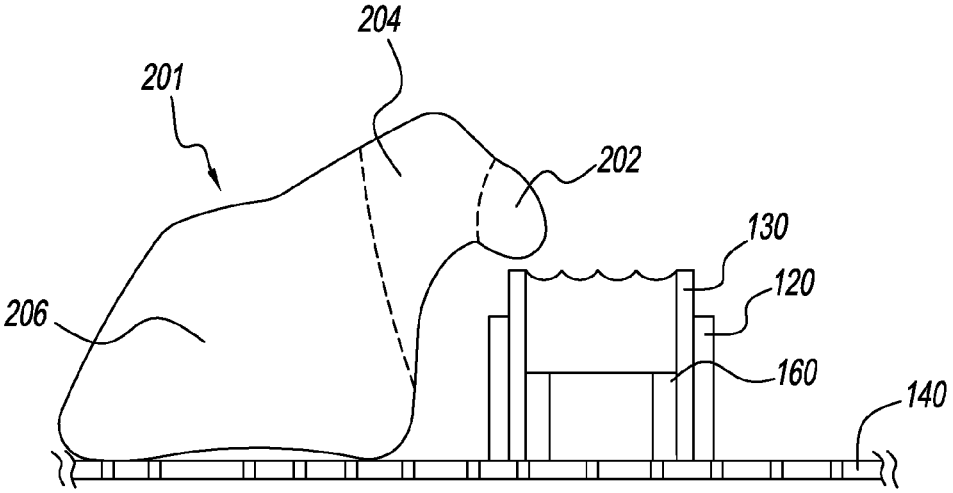
FIG. 7 is a side view of the system of FIG. 6.
Figure 8:
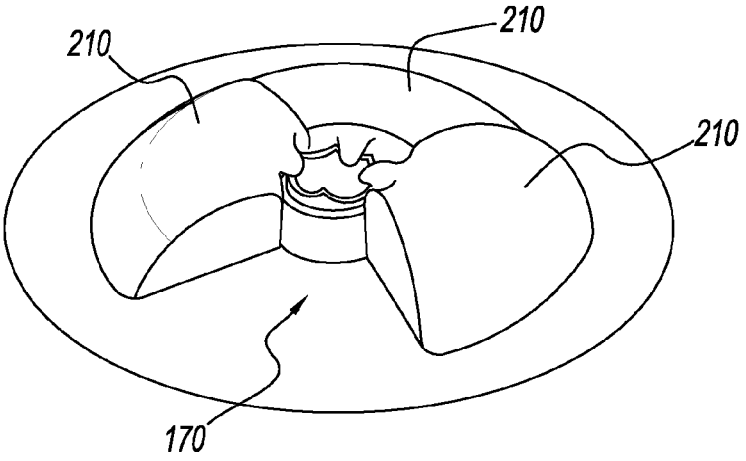
FIG. 8 is a perspective view of a portion of the fuel burning system of FIG. 2 with a third embodiment solid fuel.
Figure 9:
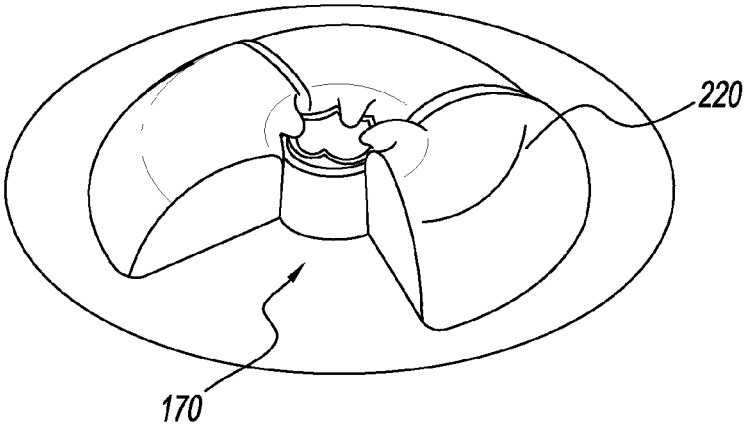
FIG. 9 is a perspective view of a portion of the fuel burning system of FIG. 2 with a fourth embodiment solid fuel.
Figure 10:
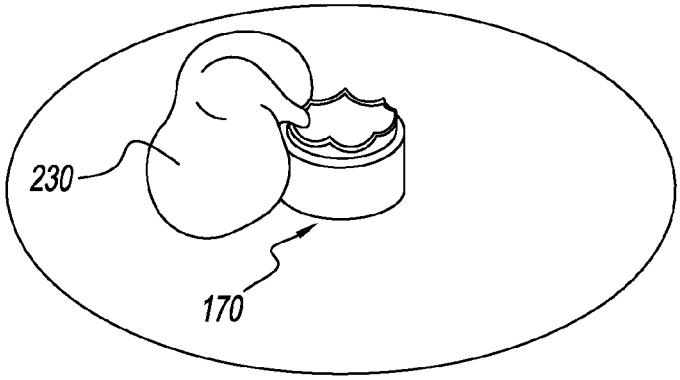
FIG. 10 is a perspective view of a portion of the fuel burning system of FIG. 2 with a fifth embodiment solid fuel.

Another embodiment of a wickless solid fuel 201 is shown in FIGS. 6-8. Referring to FIG. 7, the solid fuel comprises a priming section 202, a stoking section 204, and a main section 206. The different sections 202, 204, 206 of the solid fuel may be comprised of different fuel formulations, varying in a number of aspects including but not limited to melting point, vaporization point, oil content level, type of oil (fragrance, insect repellent, short chain hydrocarbons, medicinal ingredients, glycol, or other), and total mass.

In FIG. 7, the priming section 202 is configured to be positioned above at least a portion of the wick 130. In some embodiments, the priming section is in contact with the upper surface 132 of the wick 130. In some embodiments, the priming mass is adjacent but not directly above the wick 130. When a portion of the priming section is located above the wick, the wick portion below the overhanging priming section may be an ignition portion where the priming section will flow. This ignition portion is generally an upper portion of the wick with a relatively small total mass to keep the total heat capacity at the point of ignition at a minimum. In this manner and as shown in the designs of wicks 130, 330, 340, 350, 360, 370, 390, 400 the ignition portions can be the peaks along the wick. Likewise the raised portions of the wicks 410 and 420 may also be ignition portions. As a result, there can be multiple ignition portions about the top edge of the wick, any of which can receive the fuel from the priming section of the refill and be ignited.

Instead or in addition to the ignition portions of the wick, a starter wick, such as starter wick 180 may be used adjacent to the main wick to transfer the flame to the main wick. The starter wick, similar to the ignition portions of the wick, will have a lower total mass designed for quick ignition. The starter wick can act as a pilot light for the main wick, which may have a much larger heat capacity and therefore require a much longer time to ignite as compared to the starter wick.

The priming section is positioned so as to allow a typical igniting flame from a match or lighter to be in contact with the wick and to be close enough to melt at least a portion of the priming section. The priming section, once melted, preferentially flows toward and into the wick. The priming section, when melted, may fall directly on top of the wick, and/or it may fall on to the side wall of the wick, and/or it may fall adjacent, but not directly on the wick, but then flow toward and make contact with the wick. The priming section has generally the smallest mass as compared to sections 204 and 206 because it, along with the wick, needs to be elevated to ignition temperature quickly by the flame. A larger mass will take longer to melt and provide fuel to the wick. Therefore the priming section enables an accelerated flame start time at the wick. The priming section is sized to balance, during ignition, between not enough fuel to ignite the wick and not too much melted fuel so as to avoid flooding the wick.

The priming section may be initially melted by the ignition source, such as a match, lighter, or other flame source, before the flame begins on the wick. Once the flame begins on the wick and the ignition source is removed the flame on the wick will continue to melt the priming section. In some embodiments, the priming section, when melted by the ignition source, will flow directly to the portion of the wick that will first be ignited which is generally at or adjacent the placement of the ignition source.

In some embodiments, the priming section has a mass in the range of 0.01 grams to 0.5 grams and hangs over the top of the wick in such a manner that when the fuel melts, the resulting flow creates one or more drops of fuel that prime the wick. In some embodiments, the priming section has a mass of 0.5 grams or less.

The stoking section 204 is close enough to be melted primarily from heat radiation by the newly ignited flame at the wick and is generally of larger size than the priming section 202 because it needs to supply the fuel to wet the totality of the wick so that the full flame may develop. Unlike the priming mass, however, the stoking section needs to flow primarily away from the flame and toward the bottom portion of the wick otherwise the wick or flame may become flooded. Therefore the stoking section is positioned close enough to the flame to melt the fuel via radiating heat but far enough away to make sure the melting wax does not flow into the flame and flood the wick. A flooded wick would result in very slow flame development or may extinguish the flame. Flow channels, such as flow paths B and C of FIG. 14K, may be provided to route melting wax so that it does not flood the flame The melted stoking mass flows away from the ignited section of the wick and down toward the base of the wick system, entering the wick system 170 from the bottom, and wetting the wick from the bottom. This feeding of the wick from the bottom stokes the flame as it develops more fully. In this manner, the newly ignited flame is not at risk of flooding and will not starve itself of fuel since the melted fuel is delivered quickly to the wick system 170.

The function of the stoking section is to fully develop the flame and increase the system operating temperature above that of the melt point of the solid fuel. The stoking section must be of sufficient mass to allow the flame to burn until the system reaches the desired melting temperature. If not, the system will be starved of liquid fuel and the ignited flame will go out leaving a solid mass of wax fuel behind. The stoking section must also be designed in such a way as to avoid flooding the wick at or near the ignition area. This is done by creating a physical design of the stoking section and its placement relative to the wick system that allows the melted fuel of the stoking section to flow to the wick either beneath the ignited portion of the wick or to the side of the ignited portion of the wick.

In some embodiments, the stoking section has a mass in the range of 0.25 grams to 2.5 grams. In some embodiments, the stoking section has a mass greater than 0.24 grams and less than 3 grams. In some embodiments, the stoking section has a mass that is 5 times the mass of the priming section. In some embodiments, the stoking section has a mass that is 25 times the mass of the priming section. In some embodiments, the stoking section has a mass that is in the range of 5 to 2500 times the size of the priming section.

The main section 206 is the largest of the three sections 202, 204, 206. The main section provides the bulk of the fuel that is melted primarily from conductive heat. Conductive heat is transferred from the flame through the wick sheath to the melting grate to the main section 206 in contact with the melting grate and within a radiating distance there from. Main section may also be heated through radiant heat transferred through ambient air from the flame at the wick. The main section provides a continuous supply of melted fuel to the base of the wick system to be drawn in and combusted in the burn chamber of the wick system 170 until the fuel in the lower fuel reservoir area 158 is exhausted. The main section is generally the furthest section from the flame and wick.

The main section has a mass that is sized depending on the desired total burn time of the system without a refill as well as the size of the melting grate 140 and/or the reservoir 150. In some embodiments, the main section has a mass in the range of 3 grams to 25 grams. In some embodiments, the main section has a mass in excess of 25 grams.

In some embodiments, the main section has a mass that is 10 times the mass of the stoking section. In some embodiments, the stoking section has a mass that is 12 times the mass of the stoking section. In some embodiments, the stoking section has a mass that is greater or equal to 10 times the size of the stoking section.

The solid fuel 210 may be configured, when placed adjacent other solid fuel as shown in FIG. 8, to form a completely surrounding fuel configuration about the wick system 170. FIG. 8 shows one solid fuel missing so that the wick system 170 is visible.

When the solid fuel 201 is positioned adjacent the reusable wick, the nature of the geometry of the solid fuel will manage the igniting, forming, and maintaining the desired flame. Upon placing a match, lighter, or other igniting element close to the point where the solid fuel touches or is adjacent the wick, the heat from the ignition source melts the relatively small amount of wax that then flows toward and into the wick from the top of the wick system. Because the total mass of the priming section fuel combined with the wick is small relative to the mass of the full wick filled with fuel, the ignition flame then can elevate the collective mass of the of the full wick and melted fuel to its ignition temperature and the system is primed.

Once the wick is ignited, the flame then melts through the remainder of the priming section and into the stoking section 204 of the wickless refill through radiating heat from the flame though the ambient air. However, rather than drawing the newly melted fuel directly into the flame, this section of melting fuel runs away from the flame and toward the bottom end of the wick, seeking to fully replenish the wick with melted fuel without restricting or flooding the developing flame at the top. The spacing of the stoking section from the wick system 170 should be such as to allow space for the newly melted wax to flow so that it does not flow down onto the flame. The wax melting from the stoking section generally, during at least a portion of the melting of the stoking section, travels down the exterior of the wick sheath that itself is beginning to be heated by the flame above. As the melted wax begins to fill or saturate the bottom of the wick, it enables the full development of the desired flame.

As the larger and more fully developed flame grows fed by fuel from the stoking section, the main section 206 begins to melt via conductive heating. The main section 206 is larger and comprises more mass than the stoking section or the priming section. The main section continues to supply/replenish the fuel within the wick from the bottom portion of the wick until the total mass of all fuel is exhausted and the flame is extinguished. When the flame runs out of fuel and is extinguished it will leave behind a dry wick ready to be used by another wickless wax refill.

Numerous geometries might be utilized to prime the wick by moving a relatively small amount of fuel to the point of ignition, to stoke the flame by moving more fuel away from the flame and toward the bottom of the wick, and to supply and replenish the reservoir 150. Exemplary embodiments of solid fuel 210, 220, 230, 240, 250, 260 geometries are shown in FIGS. 8-13, each of which have a priming section, a stoking section, and a main section.

Figure 11:
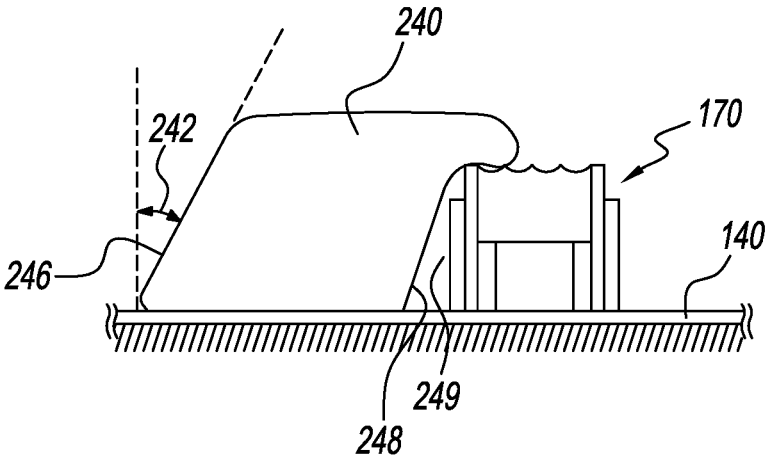
FIG. 11 is a perspective view of a portion of the fuel burning system of FIG. 2 with a sixth embodiment solid fuel.
Figure 12:
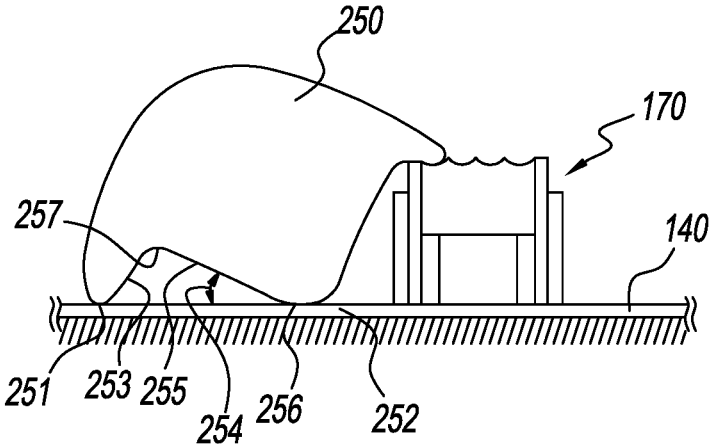
FIG. 12 is a perspective view of a portion of the fuel burning system of FIG. 2 with a seventh embodiment solid fuel.
Figure 13:
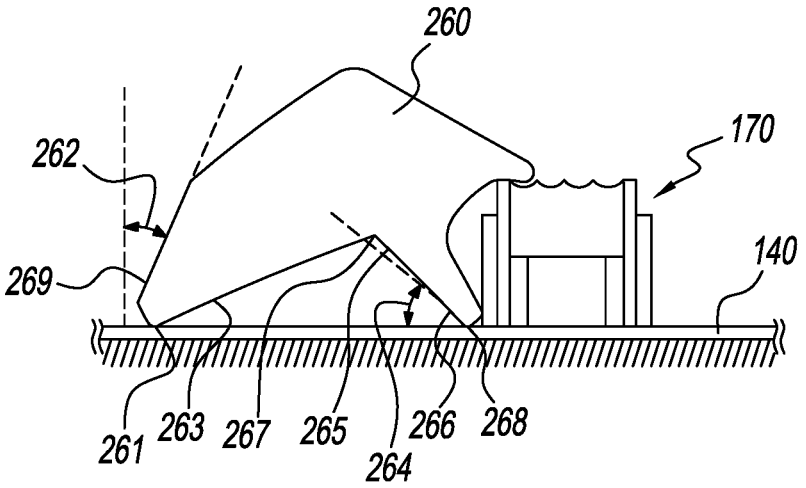
FIG. 13 is a perspective view of a portion of the fuel burning system of FIG. 2 with a eighth embodiment solid fuel.

As shown in FIGS. 11-13, the solid fuel can be form so that its cross section has a center of gravity biased toward the flame. Generally, the cross sections exhibit either an angle of incidence 254, 264 or an angle of list 242, 262 or both to create a structure that naturally falls toward the flame as the fuel melts and as the flame's melting radius increases. As the fuel falls forward during melting more of the fuel is moved closer to the flame to accelerate melting.

FIG. 11 shows a solid fuel 240 having an angle of list 242 of between 10 and 20 degrees along a rear wall 246. An air gap 249 between a front wall 248 of the solid fuel and the 170 wick system. The front wall is parallel to the rear wall.

FIG. 12 shows a solid fuel 250 having the angle of incidence 254 along its lower wall 256. The lower wall 256 has a rear contact surface or point 251 and a front contact surface or point 252, each configured to contact the melting grate. Extending from the rear contact surface 251 is a first upwardly extending surface 253. Extending from the front contact surface 252 is a second upwardly extending surface 255. The second upwardly extending surface meets with the first upwardly extending surface at an apex 257. The first and second upwardly extending surfaces are converging. The first upwardly extending surface is shorter in length than the second upwardly extending surface. The angle of incidence is formed between the melting grate and the second upwardly extending surface.

Figure 14:
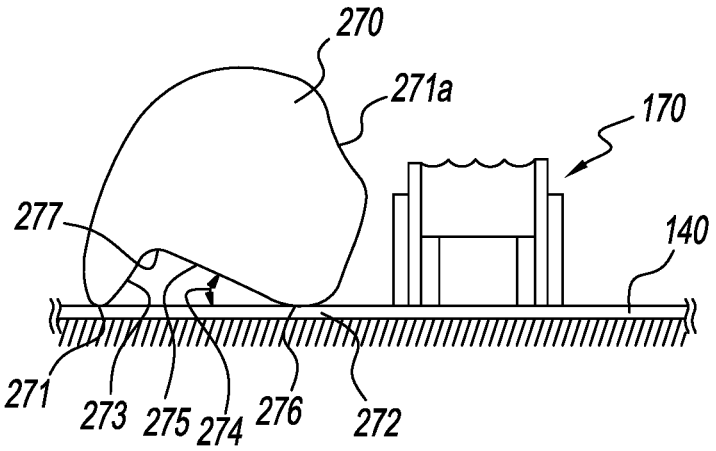
FIG. 14 is a perspective view of a portion of the fuel burning system of FIG. 12 with the seventh embodiment solid fuel partially consumed.
Figure 14A:
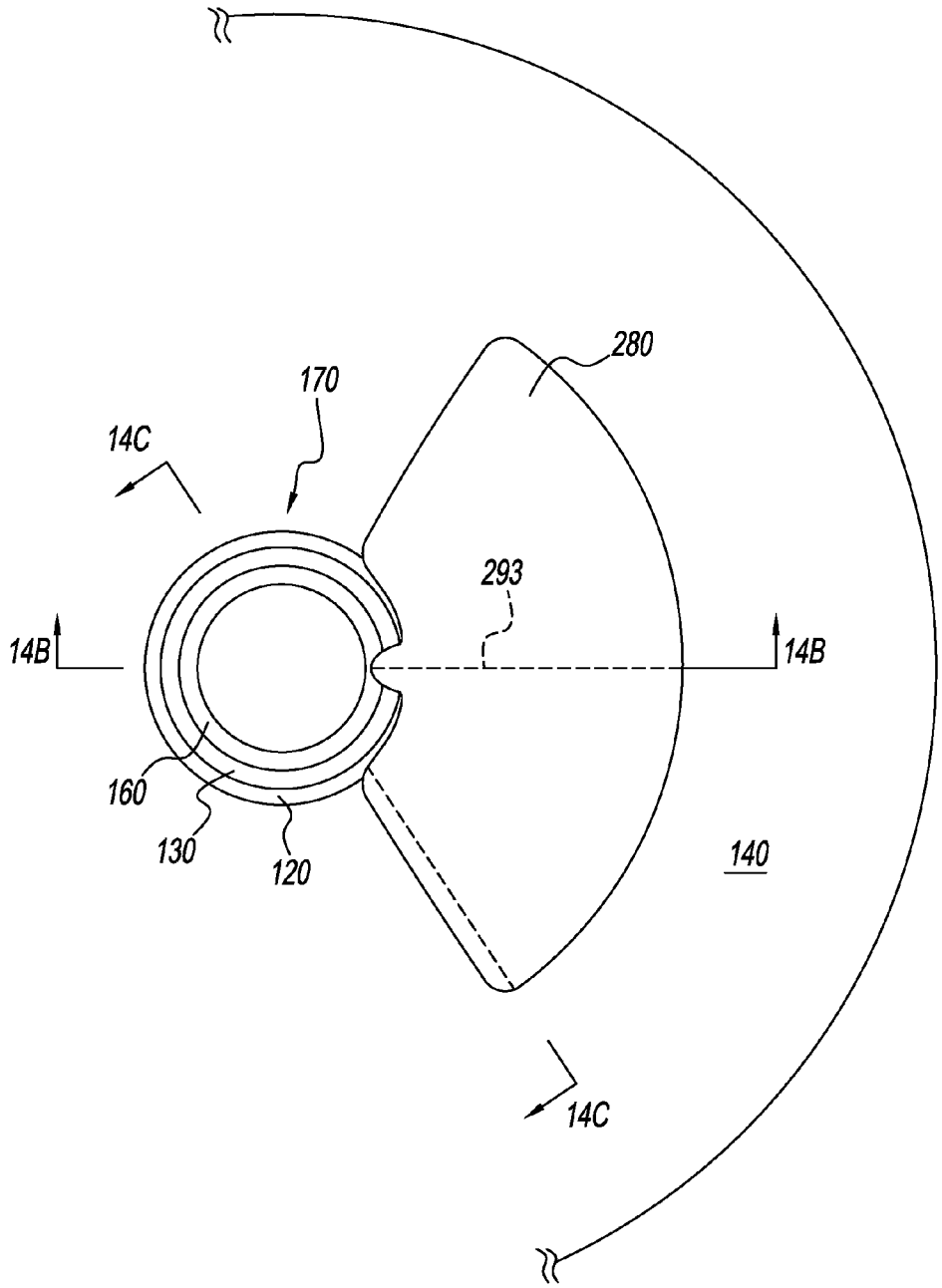
FIG. 14A a perspective view of a portion of the fuel burning system of FIG. 2 with a ninth embodiment solid fuel.

As the front contact surface 256 is located closer to the wick system 170, it will tend to melt first causing the solid fuel to sink further forward as shown in FIG. 14. FIG. 14 shows the solid fuel 270 which began in the shape of the solid fuel 250 of FIG. 12 but has melted by a flame (not shown) burning on the wick for a period of time. The lower wall 276 has a rear contact surface or point 271 and a front contact surface or point 272, each configured to contact the melting grate. Extending from the rear contact surface 271 is a first upwardly extending surface 273. Extending from the front contact surface 272 is a second upwardly extending surface 275. The second upwardly extending surface meets with the first upwardly extending surface at an apex 277. In FIG. 14 the second surface 275 is shorter than in FIG. 12 because the front portion of the fuel has melted along the front contact surface and along a portion of what used to be the second upwardly extending surface 275.

FIG. 14 also shows that the upper portion of the solid fuel will melt more quickly than the lower portion, as shown along sloped section 271*a* because the upper portion is in closer proximity to the flame during initial burning. Therefore the diagonal nature of the stoking section 204 as shown in FIG. 7 is due to the fact that the heat from the flame will melt the upper portion of the solid fuel earlier in the burning process.

FIG. 13 shows a solid fuel 260 with an angle of list 262 along a rear wall 269 of the solid fuel and angle of incidence 264 along the lower wall 266 of the solid fuel. The lower wall 266 has a rear contact surface or point 261 and a front contact surface or point 268, each configured to contact the melting grate. Extending from the rear contact surface 261 is a first upwardly extending surface 263. Extending from the front contact surface 268 is a second upwardly extending surface 265. The second upwardly extending surface meets with the first upwardly extending surface at an apex 267. The first and second upwardly extending surfaces are converging. The first upwardly extending surface is shorter in length than the second upwardly extending surface. The angle of incidence is formed between the melting grate and the second upwardly extending surface. In some embodiments, angle of list 262 before melting is in the range of 0 to 30 degrees and angle of incidence 264 before melting is greater than angle 262 and is up to 90 degrees.

FIGS. 14A-K show another embodiment of a solid fuel 280. The solid fuel has a body 281, arms 282, 283, and a main protruding section 284. The body 281 has a back wall 285, an upper front wall 286, a lower front wall 287, a bottom wall 288, a left side wall 289, a right side wall 290. The back wall joins with the upper front wall, and the front wall joins with the bottom wall. The left and right side walls define the radial ends of the solid fuel. Each of the walls may meet a corresponding other at a curved joints as shown in FIGS. 14D-K.

The main protruding 284 has an upper protruding section 284*j* comprising a first forwardly extending portion 284*a* and a second forwardly extending portion 284*b* joining the first forwardly extending portion 284*a* at a curved nose section 284*i*. The upper protruding section 284*j* has opposite inwardly converging sidewalls 284*g*, 284*h*. Below the upper protruding section 284*j* is a mid section having a first facing surface 284*c*. Below the mid section, is a lower section 284*k* having a first front wall 284*d*, and a first lower wall 284*m*. The first lower wall 284*m* extends from the body 281. The first front wall 284*d* meets the first lower wall 284*m* at a curved intersection 284*l*. The lower section 284*k* has opposite side walls 284*e*, 284*f*. The main protruding section may be located at the midpoint between the side walls 289, 290.

The lower front wall 287 curves inward to create an open pool space 291 between the body adjacent and between the arms 282, 283. This pool space allows melting wax to gather between the body and the wick sheath to continue fueling the wick without flooding the wick. If open pool space 291 forming a gap 219 between the bottom 287*a* of the lower front wall 287 did not exist, the wax may flood the wick and extinguish the flame.

The solid fuel 280 is formed so when the arms contact the wick sheath the upper protruding section 284*j* is properly positioned above the wick. Therefore, melted wax from the priming section, which includes the portion of curved nose section 284*i* that extends over the wick, can fall on the wick and initiate ignition of the wick. Further the arms ensure there this is sufficient space within the pool space 291 for wax from the stoking section to flow down the solid fuel and to the base of the wick sheath to fuel the wick from the bottom. In some embodiments, the gap 219 between bottom 287*a* of the lower front wall 287 and the wick sheath is 0.125 inches at the bisecting vertical midline 293.

Each of the arms are mirror image identical about the bisecting vertical midline 293. Therefore only arm 283 will be described. The arm has a rising bottom section 283*a*, which meets the upper portion 238*b* at a curved end 283*c*. As shown in FIG. 14G, the curved end 283*c* does not extend substantially beyond the forward most portion of the upper front wall 286. In some embodiments, the curved end 283*c* is co-planer with the forward most portion of the upper front wall 286. The arms rise above the lower most bottom 288 as the arms extend away from the body.

Figure 14B:
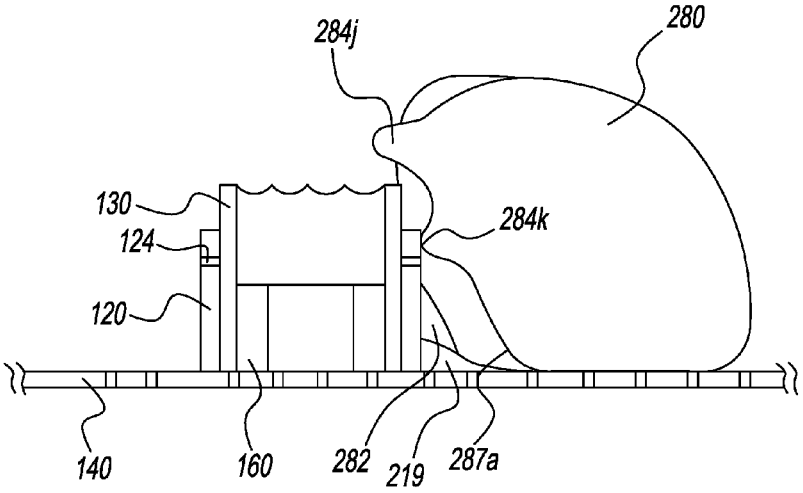
FIG. 14B is sectional side view taken along line 14B-14B of FIG. 14A.
Figure 14C:
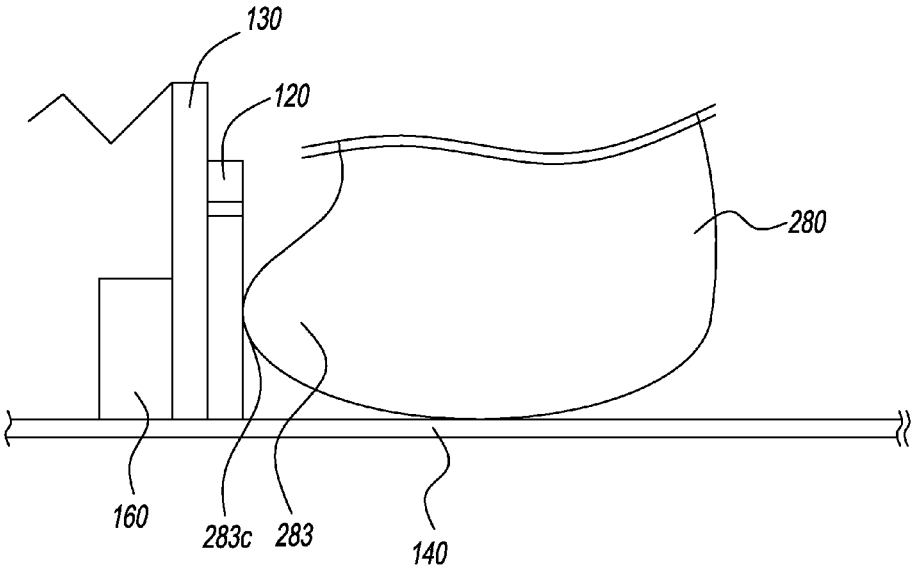
FIG. 14C is sectional side view taken along line 14C-14C of FIG. 14A of the fuel burning system of FIG. 2 with a lower portion of the ninth embodiment solid fuel.
Figure 14D:
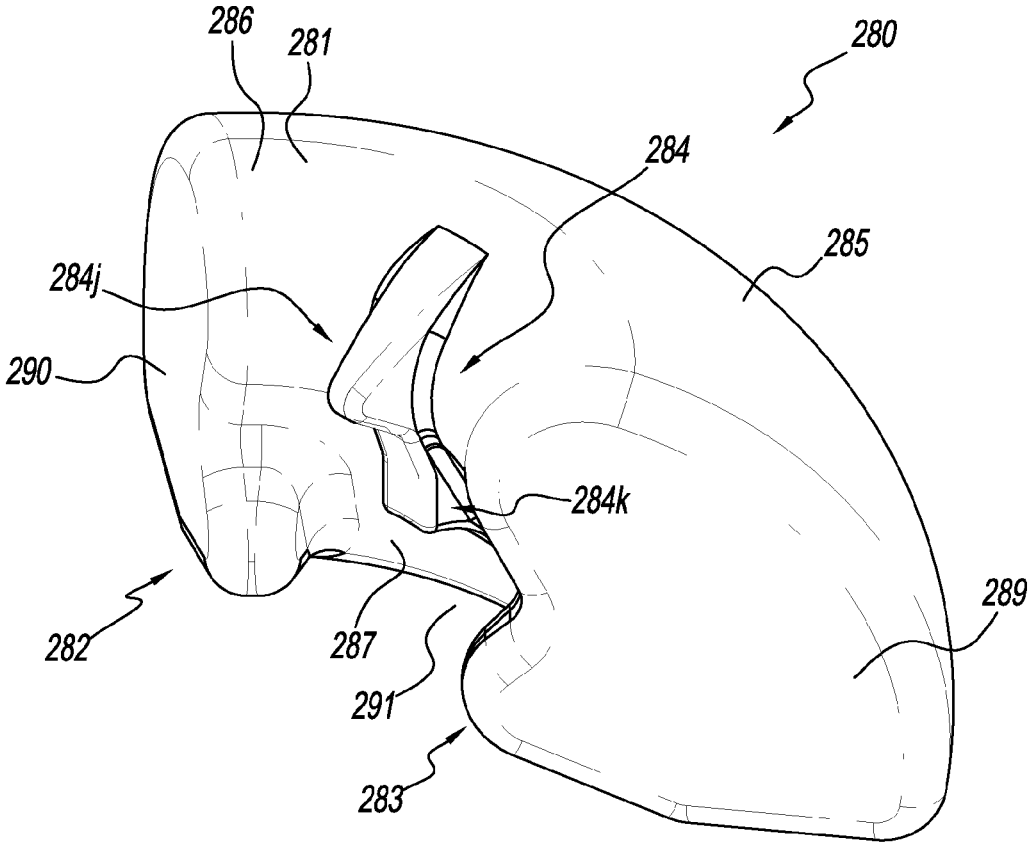
FIG. 14D is a perspective view of the ninth embodiment solid fuel of FIG. 14A.
Figure 14E:
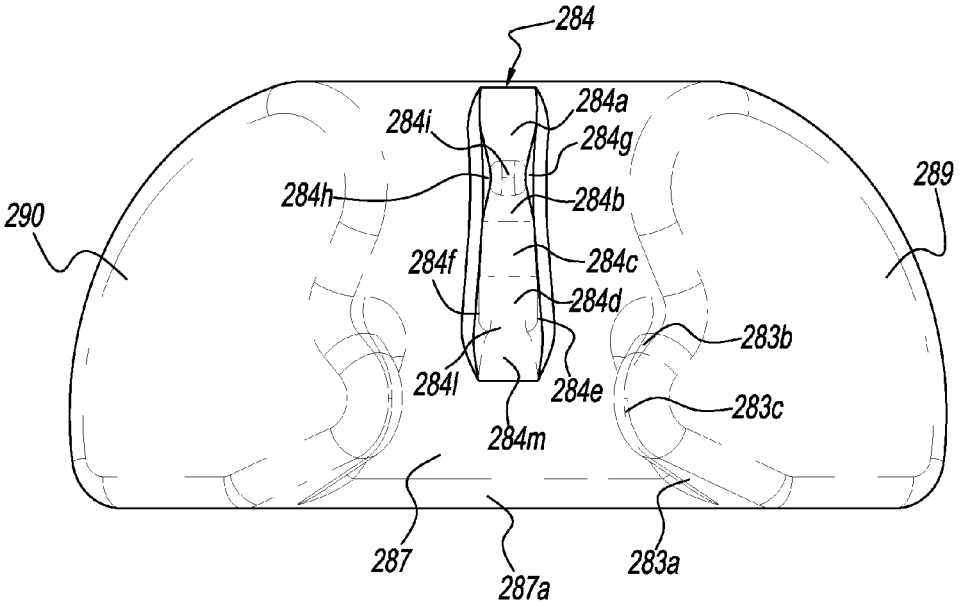
FIG. 14E is a front view of the solid fuel of FIG. 14A.
Figure 14F:
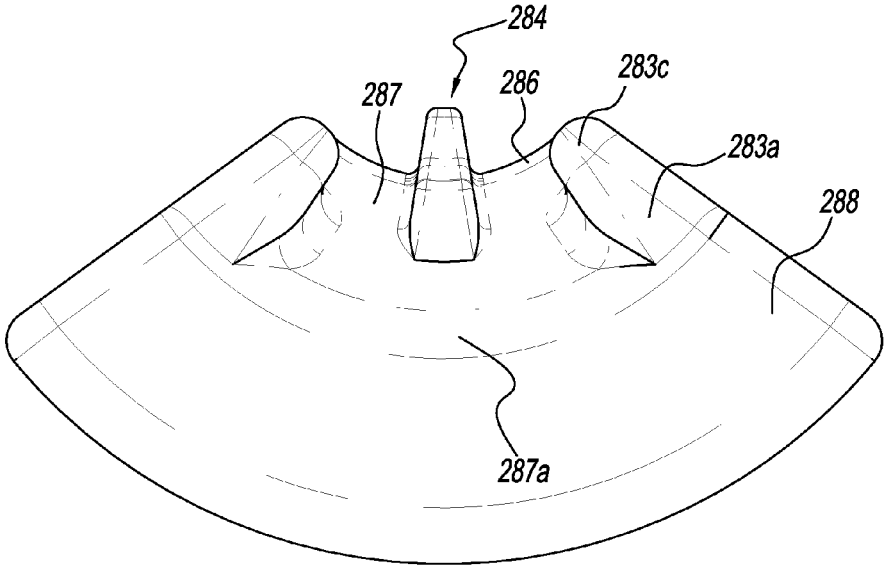
FIG. 14F is a bottom view of the solid fuel of FIG. 14A.
Figure 14G:
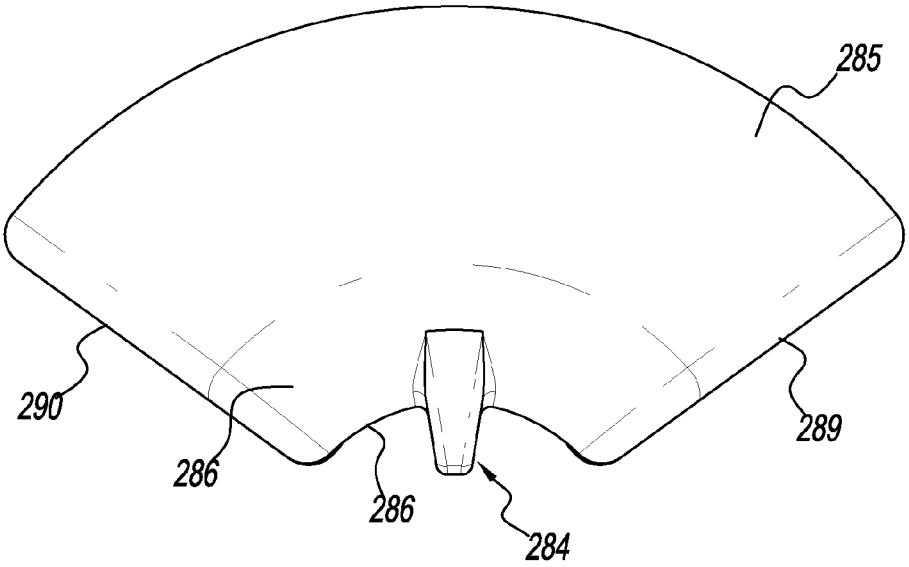
FIG. 14G is a top view of the solid fuel of FIG. 14A.
Figure 14H:
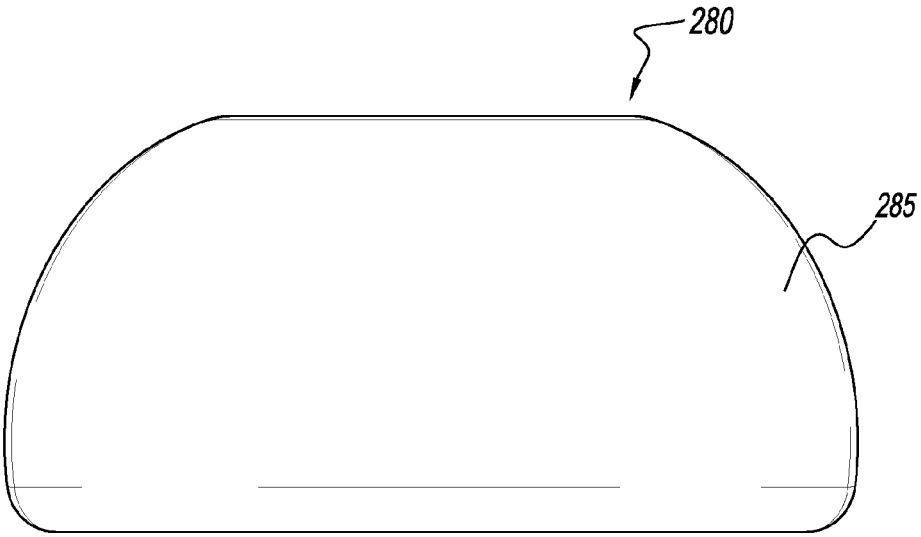
FIG. 14H is a rear view of the solid fuel of FIG. 14A.
Figure 14I:
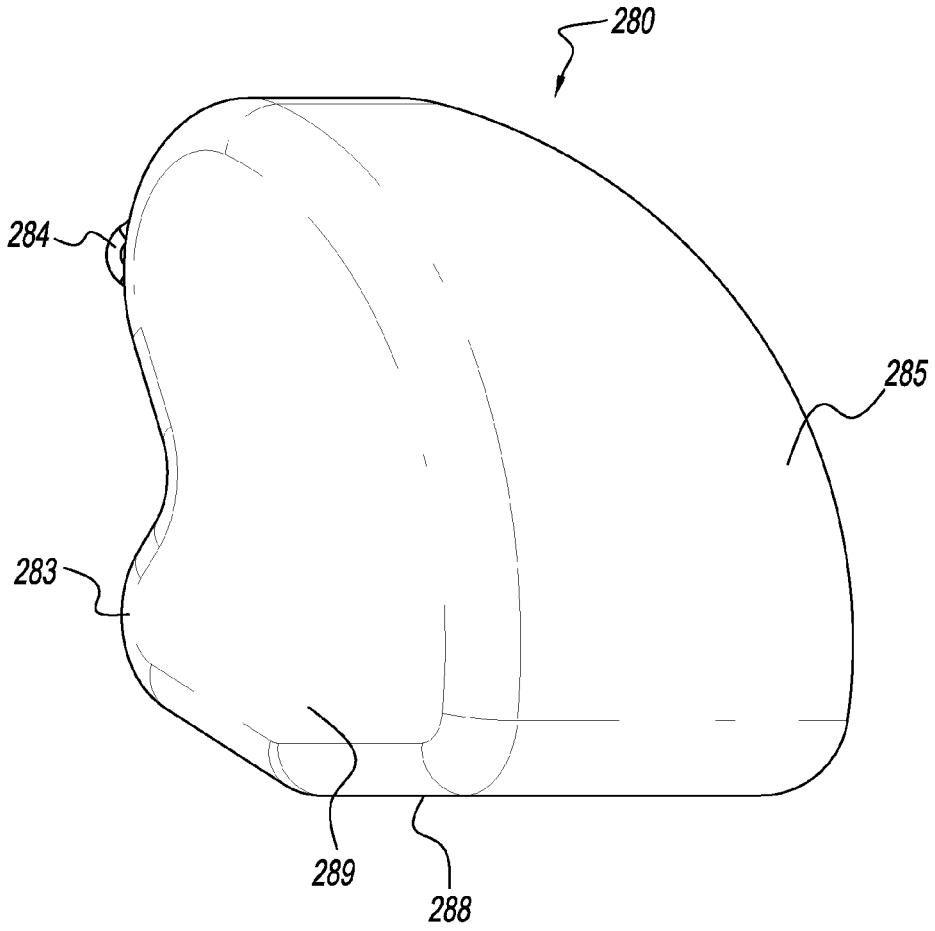
FIG. 14I is a left side view of the solid fuel of FIG. 14A.
Figure 14J:
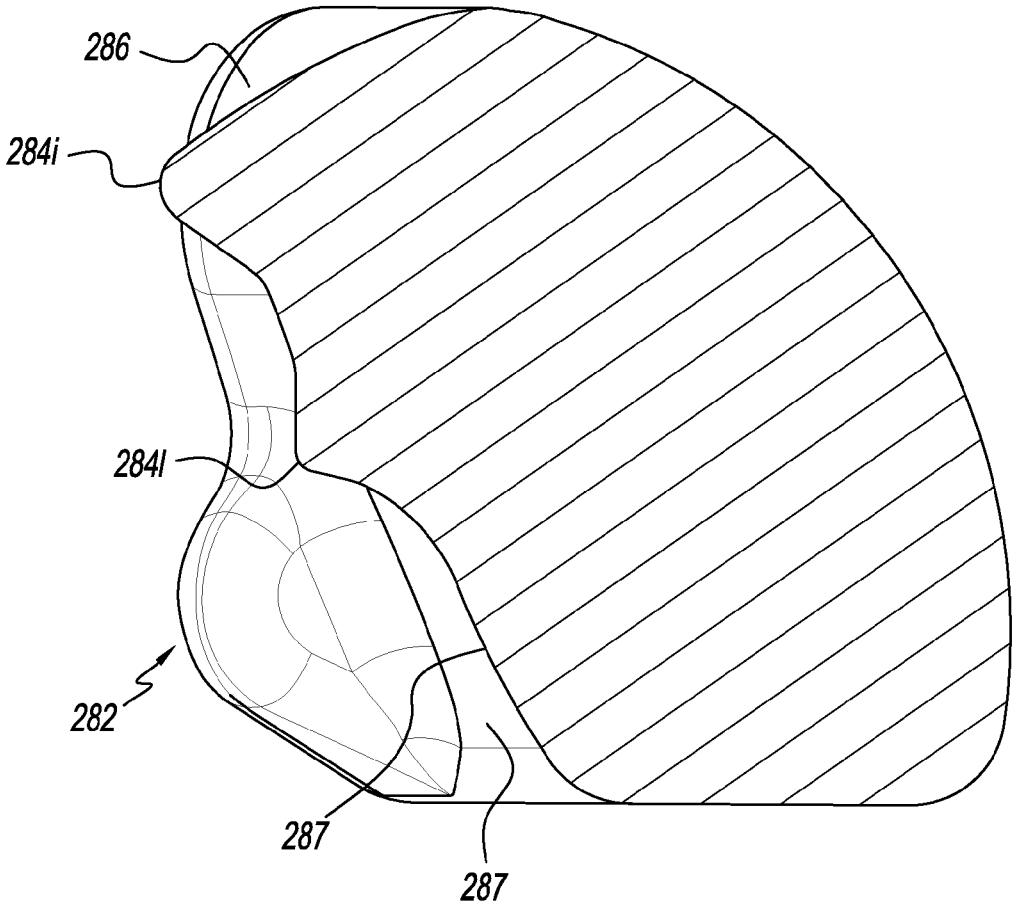
FIG. 14J is a sectional side view of the solid fuel of FIG. 14A taken along line 14B-14B of FIG. 14A.

In some embodiments, the lower section 284*k* and/or the mid section having a first facing surface 284*c* are configured to contact the wick sheath, as shown in FIG. 14B, when the upper protruding section 284*j* is properly positioned above the wick. Therefore the lower section 284*k* and/or the mid section together with the arms create three points of contact between the solid fuel and the wick sheath that properly position the solid fuel and the priming section relative to the wick. FIG. 14C shows a lower portion of the end of the solid fuel 280 with the arm 382 in contact with the wick sheath.

Figure 14K:
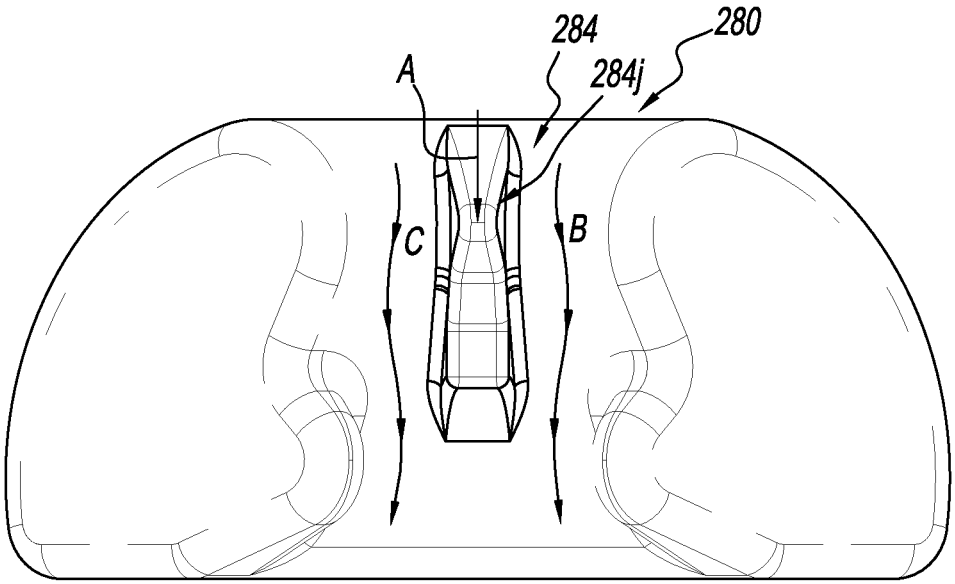
FIG. 14K is a front view of the solid fuel of FIG. 14A.

FIG. 14K shows a number of flow paths along which melted wax may flow when heated by the heat generated from the flame on the wick system 170. A priming flow path A delivers melted fuel directly to the top of the wick. The melted wax moving along priming flow path A will fall off of the upper protruding section 284*j* onto the top of the wick unit the upper protruding section 284*j* has melted to the extent that it no longer extends over the top of the wick. Stoking flow paths B and C deliver melted wax to the open pool space 291 where it will flow to the bottom of the wick sheath and be absorbed into the bottom of the wick.

In some embodiments, the wick sheath is not welded or sealed to the melting grate along its entire circumference and as the wax becomes more easily flowing through higher temperatures, some wax will flow between the melting grate and the bottom of the wick sheath and into the bottom of the wick without falling through the melting grate and into the reservoir. As the wax begins to melt, it may be slow flowing wax that will not immediately fall through the holes in the melting grate. Therefore wax will pool on the surface of the melting grate in the gap 219 during initial burning.

Clog Resistance.

Figure 15:
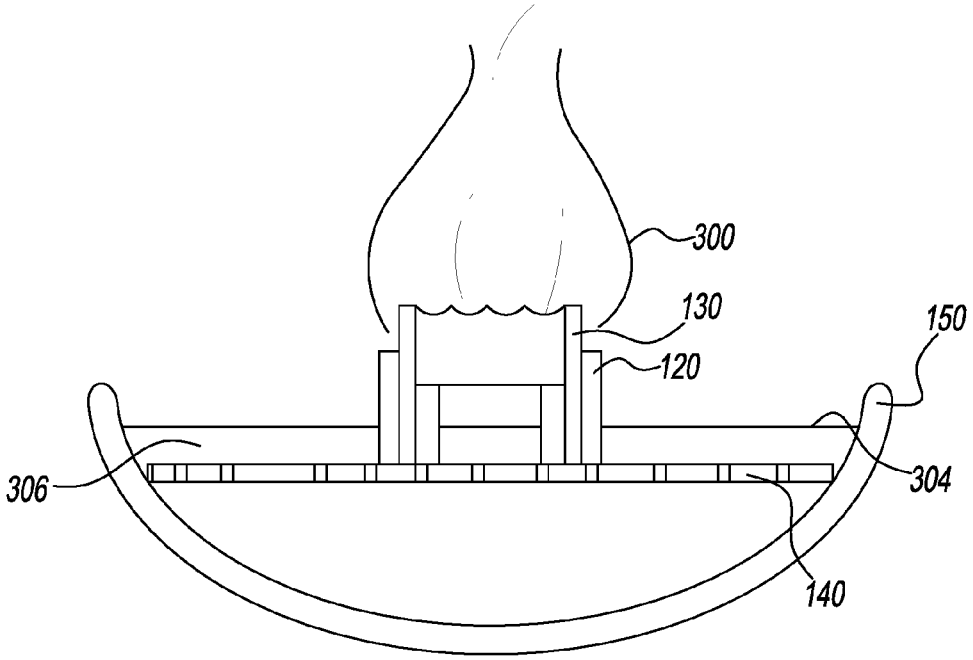
FIG. 15 is a side view of a portion of the fuel burning system of FIG. 2.
Figure 16:
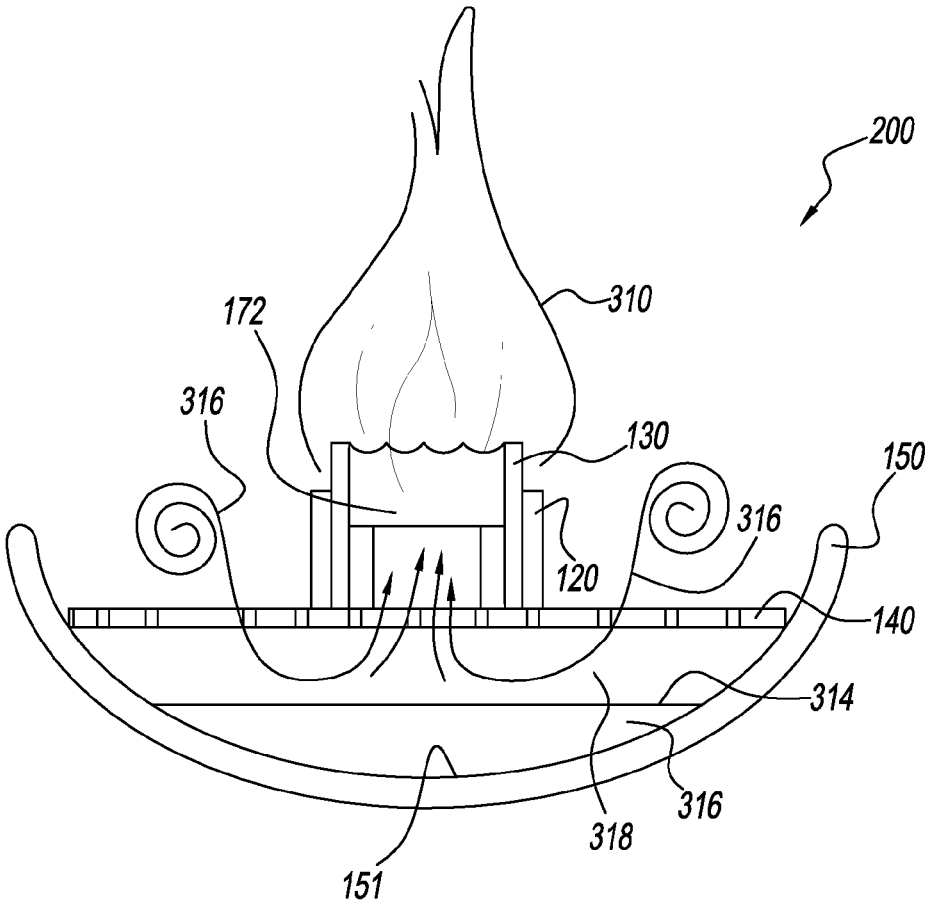
FIG. 16 is a side view of a portion of the fuel burning system of FIG. 2.

A system of method of resisting or preventing clogging of a reusable wick is disclosed. FIGS. 15 and 16 show the system 200 in various states of operation. In FIG. 15 the fuel level 304 of the liquid fuel 306 is risen above the melting grate 140 and above the bottom of the wick 130. The wick is at least partially submerged in the liquid fuel.

FIG. 16 shows the system 200 where the liquid fuel 316 has a fuel level 314 that is below the melting grate 140 and below the bottom of the wick 130. There is an air gap 318 between the fuel level 314 and the melting grate and wick.

Certain advantages are achieved when the liquid fuel level 314 is not in direct contact with the wick. When the fuel level 314 is not in direct contact with the wick 130, air 316 is drawn through the melting grate and into the bottom of the burn chamber 172 of the wick system 170. The gap 318 can be macroscopic in scale or microscopic, as long as it creates a situation where the bottom most portion of the wick material is no longer in direct contact with the fuel housed in the fuel reservoir 150 and there is a path for air to be drawn into the burn chamber from the lower opening of the wick system 170.

The gap 318 provides for an arrangement that resists or eliminates wick fouling or clogging for at least two reasons. First, throughout the operation of the system 200, since the bottom most portion of the wick is not in contact with the lowest portion of the fuel reservoir, any solids or particles that are suspended in the fuel will precipitate or fall to the bottom of the fuel reservoir and will not enter the wick material.

Second, when the fuel level sits above the melting grate, covering the bottom portion of the burner assembly and delivering fuel to the flame directly through the wick material as shown in FIG. 15, the flame 300 is sustained. However, when the fuel level is maintained below or drops beneath the grating or false bottom, the heat created by the system 200 continues to vaporize the fuel near but not in direct contact with the bottom of the burn chamber. The vaporization will occur at or adjacent the surface 314 of the liquid fuel.

As a gap is created or maintained between the bottom of the wick and the top of the fuel level 316, air begins to be drawn into the burn chamber through the bottom of the burn chamber 172. The drawn air picks up the vaporized or gas phase fuel as it proceeds into the burn chamber and/or onto the wick and the vaporized or the vapor phase paraffin is combusted. Generally wax fuels vaporize at temperatures between 390 F and 420 F depending on the type of wax. With the addition of more air into the burn chamber, the resulting fire/flame 310 burns hotter, creates more thermal energy that vaporizes more fuel, then the flame of the system operating as shown in FIG. 15 with the wick submerged in the liquid fuel. As the gap widens, toward the end or exhaustion of the fuel supply in the reservoir 150, more air will be drawn into the burn chamber and with the air more vaporized fuel, which will cause the flame to burn hotter. The flame will stop if the gap becomes too great to allow fuel to be vaporized and drawn into the chamber or if that does not first occur, then when the fuel is completely or consumed. The distance after which the gap between the wick and the liquid fuel is too great to fuel the fame depends on the scale of the overall system. In one embodiment, a gap distance of greater than ⅜ of an inch was found to be too great to continue fueling the wick. However, in larger scale systems, fueling may continue even after a ⅜ inch gap is achieved. As a result of the increase burn temperature during the end of the fuel supply, the system provides for a self-cleaning cycle where the wick eliminates or avoids particulate build up during the hotter operating temperatures at the end of fuel consumption. The self-cleaning cycle begins when the liquid level of fuel drops below the bottom of the wick and continues until no more fuel can be vaporized from the surface of the melt pool from the radiation of the flame.

Therefore the gap allows vaporized fuel to be drawn into the burn chamber premixed with oxygen with creates a hotter flame 310, as shown in FIG. 16, as compared to the stead state flame 300 that draws its fuel into the wick base a melted liquid, such as shown in FIG. 15.

Once the cleaning cycle temperature threshold is met and/or exceeded, any solids that might have clogged the wick are retained in the bottom of the fuel reservoir and any accumulated varnish, tar, carbon deposits, or other elements are consumed, volatilized, or otherwise released from the wick material as the burn chamber begins to operate at the elevated cleaning temperature. The result is an assembly resistant to the clogging or fouling than is generally seen and expected as longer chain hydrocarbon fuels like waxes or paraffin are burned.

The system provides less soot or unwanted byproducts of combustion delivered to the air because the chemical ingredients prone to incomplete combustion are either retained in the unused portion of the fuel or combusted at a higher temperature.

The gap between the bottom of the wick system and the bottom of the fuel reservoir 150 creates a thermal buffer that allows the reservoir basin or bowl to be made of materials that are otherwise prone to thermal shock or degradation.

In one embodiment, the reservoir 150 is concave in shape with a nine inch diameter and two inch height. The reservoir 150 is comprised of transparent or translucent etched glass that allows the light of the flame 310 to shine through the fuel and down to offer down lighting to the area under the reservoir. The melting grate is a flat perforated aluminum sheet of 4.25 inch diameter. This creates a distance between the melting grate and the bottom of the reservoir 150 of about 0.5 inches at the center 151 of the reservoir 150. The wick sheath has a diameter of 1.5 inch and a height of 1.1 inch and is formed by cutting aluminum tubing cut at 1.1 inch increments. The wick has a height of 1.3 and comprises Fiberfrax® 550F ceramic paper with a wavy pattern cut at the top to facilitate ignition. The solid fuel may be IGI 1239 granulated paraffin. In this embodiment, when the system reaches its end of use, the remaining fuel in the reservoir is about 0.2 inches deep at the center 151 and the entire surface of the wick, including the upper portion of the wick supporting the flame, is relatively clean of carbon deposits and is one that can easily be relit and used repeatedly.

In some embodiments, the gap between the bottom of the wick and the lower most point of the fuel reservoir 150 at the center 151 can be as small as the thickness of the melting grate. In such an arrangement the melting grate is spaced closely to the bottom of the reservoir 150. In some embodiments, the wick may comprise any kind of non-consumable material or refractory product. In some embodiments, the wick system diameter can range from 0.25 inches to in excess of 3 inches in diameter, the wick and support ring being signed correspondingly. In some embodiments, burn devices using this method can use one or a plurality of wick systems placed upon the grate to create a customized flame effect. The customized flame effect can comprise a flame pattern that spells out a message in words or letters. The customized flame effect can comprise a flame pattern emulates a flame fountain with some parts of the flame being taller than others. The flame fountain effect can be achieved by forming some wick systems that burner taller than other wick systems on the melting grate.

Wicks and Wick Sheaths.

Figure 17:
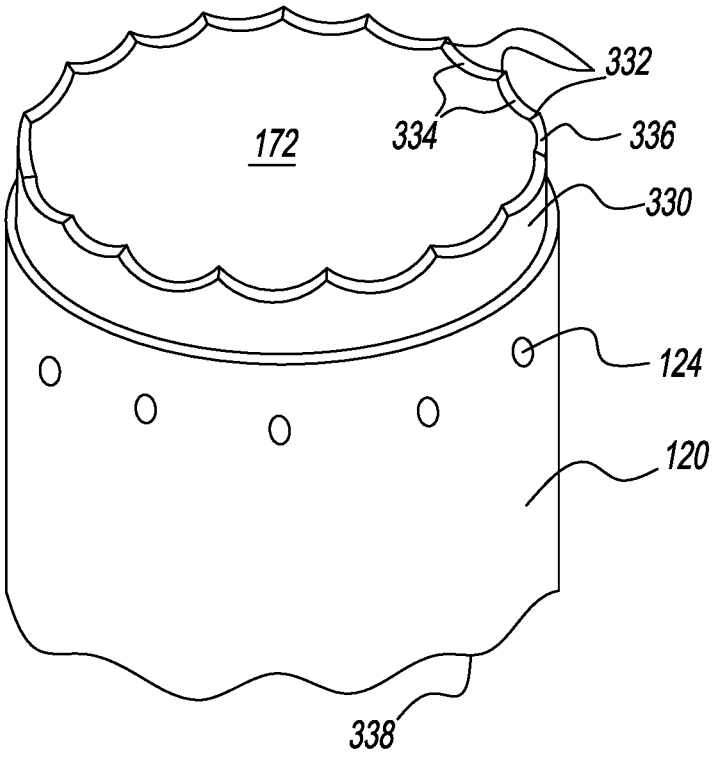
FIG. 17 is a perspective view of a wick and a wick sheath of the invention.
Figure 18:
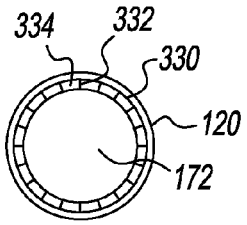
FIG. 18 is a top view of the wick and wick sheath of FIG. 17.

FIG. 17 shows a wick 330 with more peaks 332 and valleys 334 along the top edge 336 of the wick than is shown in wick 130. The wick 330 is shown within the wick sheath 120. The wick sheath is covered with wax 338 along a bottom portion of the wick sheath. FIG. 18 provides a top view of the wick 300 of FIG. 17.

Figure 19:
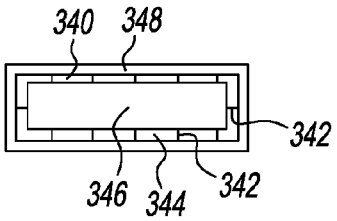
FIG. 19 is a top view of a third embodiment of a wick and a wick sheath configuration.

FIG. 19-22 shows alternative embodiment wicks and wick sheaths. FIG. 19 shows a wick 340 and a wick sheath 348 that are each rectangle. The top surface of the wick has peaks 342 and valleys 344 between the peaks. A burn chamber 346 is located within the wick. In other embodiments, the wick and wick sheath may comprise other quadrilateral shapes, such as a square or a trapezoid.

Figure 20:
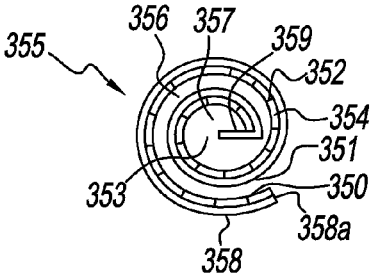
FIG. 20 is a top view of a fourth embodiment of a wick and a wick sheath configuration.

FIG. 20 shows a top view of a wick 350 and wick sheath 358 having a spiral configuration 355. The spiral configuration has an open side entrance 351. The sheath 358 has an end wall 359 at the internal end of the spiral. In this spiral configuration the inner surface of the wick faces an outside surface of the wick sheath along a portion thereof. In the center 353 of the spiral configuration a portion of the wick faces another portion of the wick rather than the wick sheath. A burn chamber 346, 347 is located within the spiral configuration 355 between the beginning 358*a* and end wall 359 of the wick sheath and/or wick. The top surface of the wick has peaks 352 and valleys 354 between the peaks.

Figure 21:
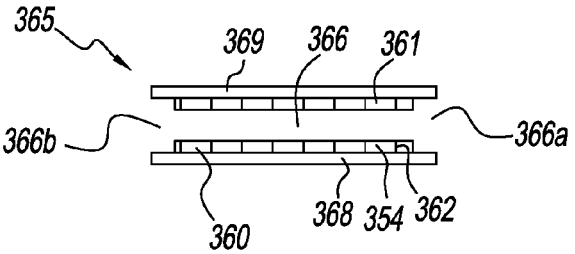
FIG. 21 is a top view of a fifth embodiment of a wick and a wick sheath configuration.

FIG. 21 shows a top view of a wick 360, 361 and wick sheath 368, 369 having a straight spaced-apart configuration 365. The straight spaced apart configuration may be a parallel configuration. The wick sheath 368, 389 is provided in two spaced apart portions and the wick is provided in two spaced apart portions 360, 361. The configuration provides for opposite open ends 366*a*, 366*b* adjacent ends of the wick and wick sheath. A burn chamber 366 is provided in the space between the interior surfaces of each wick portion 360, 361. The top surface of the wick has peaks 362 and valleys 364 between the peaks.

Figure 22:
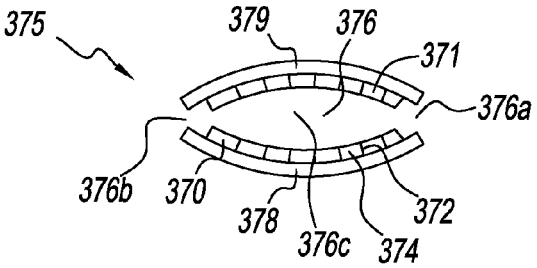
FIG. 22 is a top view of a sixth embodiment of a wick and a wick sheath configuration.

FIG. 22 shows a top view of a wick 370, 371 and wick sheath 378, 379 having a curved spaced-apart configuration 375. The wick sheath 378, 379 is provided in two spaced apart portions and the wick is provided in two spaced apart portions 360, 361. The configuration provides for opposite open ends 366*a*, 366*b* adjacent ends of the wick and wick sheath. A burn chamber 376 is provided in the space between the interior surfaces of each wick portion 360,361. The outer ends of each of the opposite wick and wick sheath portions are closer to each other along the longitudinal length than at the center 376*c*. The top surface of the wick has peaks 372 and valleys 374 between the peaks. The configurations shown in FIG. 18-22 can be used in the burner systems 100, 200 described herein.

Figure 23:
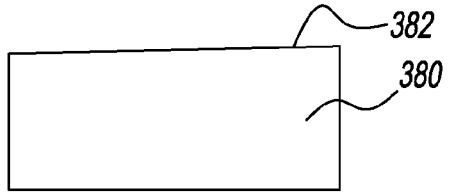
FIG. 23 is a side view of a seventh embodiment of a wick.

FIGS. 23 through 28 show alternative embodiments of top edge arrangements for wicks from a side view. FIG. 23 shows a wick 380 with a flat top edge 382.

Figure 24:
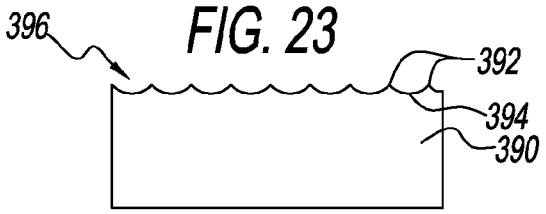
FIG. 24 is a side view of an eighth embodiment of a wick.

FIG. 24 shows a wick 390 having a wavy top edge 396. The wavy top edge has pointed or substantially pointed peaks 392 and curved valleys 394 between the peaks.

Figure 25:
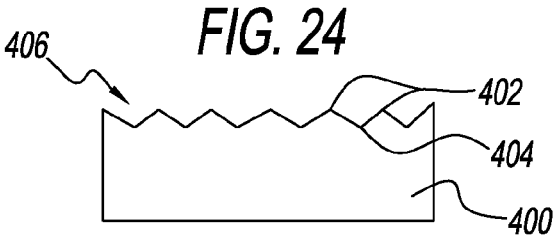
FIG. 25 is a side view of a ninth embodiment of a wick.

FIG. 25 shows a wick 400 with a jagged top edge 406. The top edge 406 has pointed or substantially pointed peaks 402 and pointed or substantially pointed valleys 394 between the peaks where the walls of the valleys or peaks are straight or substantially straight.

Figure 26:
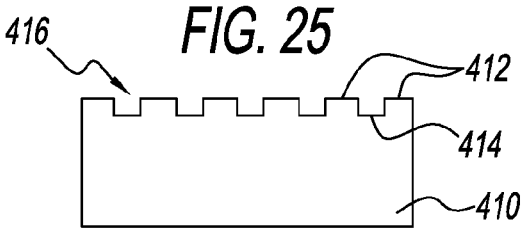
FIG. 26 is a side view of a tenth embodiment of a wick.

FIG. 26 shows a wick 410 with a notched top edge 416. The top edge 416 has plateaus 412 and valleys 414 between the plateaus. The plateaus and valleys are flat. The side walls between the plateaus and the valleys maybe perpendicular to the plateaus and the valleys.

Figure 27:
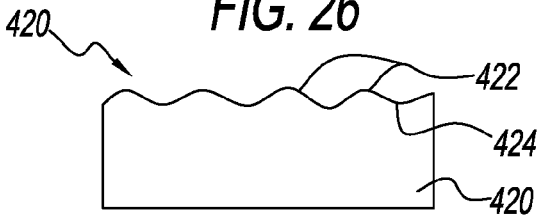
FIG. 27 is a side view of an eleventh embodiment of a wick.

FIG. 27 shows a wick 420 with a curvy top edge 416. The top edge 426 has peaks 422 and valleys 424 between the peaks. The peaks and the valleys are curved. In some embodiments, the curvy top edge resembles a sine wave.

Figure 28:
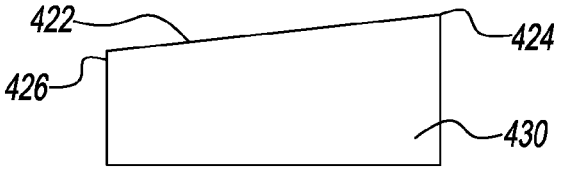
FIG. 28 is a side view of a twelfth embodiment of a wick.

FIG. 28 shows a wick 430 with an angled top edge 422. The top edge 422 has a first side 426 that is shorter than an opposite second side 424.

Each of the top edge configurations shown on wicks 380, 390, 400, 410, 420, 430, can be used any of wicks 330, 340, 350, 360, and 370. Further, a wick may use more than one top edge configuration on the same wick. For example, a wick may comprise a portion of the top edge having the jagged top edge 406 configuration and another portion of the top edge having the wave top edge 416 configuration.

The wick system uses the wick sheath to provide the boundary of the burn chamber. Within that burn chamber is wick material that only partially fills the space within the wick sheath. The wick material extends above the wick sheath to facilitate ignition and to create the top flame beneath which the vapor phase fuel is housed or staged.

The inside of the burn chamber comprises at least 10% open space. In some embodiments, the inside of the burn chamber comprises more than 50% open space. The wick material can line the inside of the wick sheath or stand apart from the wick sheath but generally has at least one surface open to the burn chamber through which surface vapor phase fuel can be delivered to the burn chamber.

A lower portion of the wick exposed to liquid or vapor fuel delivers vapor phase fuel to the burn chamber while the uppermost portion of the wick maintains the fire near the top of the burn chamber. In this way, there is always an excess of fuel ready to burn.

The combustion stoichiometry is moderated and manipulated by the access to oxygen. In the wick system, this is done generally at least in one of at least two ways. One method is to perforate the side walls, such as with the holes 124, of the wick sheath to allow air to enter into the burn chamber through the wick or directly into the burn chamber. Another method to allow oxygen into the burn chamber is around the wick surface at the top of the burn chamber. This is accomplished by creating an uneven surface upon the top of the wick, such as those shown in FIGS. 24-28. In this method, air enters from beneath or within the physical structure of the flame.

The advantages of this invention are many and some of which are provided below. The low ignition mass, both fuel and wick material, allow for both ease of ignition and faster flame development. The open geometry of the burning surface creates a larger flame without the expected increase in soot production. This larger flame, then, can be used to create much faster heat delivery to the system to melt additional solid fuel, to deliver a volatile ingredient to the air more quickly, and to create a higher operating temperature that can deliver a volatile ingredient more completely to the environment. This system works especially well if coupled with a thermally conductive base (a melting plate) or a heat conductive grate. By staging the fuel in its vapor phase (ready to burn) and limiting the access to oxygen, this invention balances the combustion stoichiometry to reduce soot production and even eliminate it at the smaller scales. The staging of the vapor phase fuel within the burner assembly creates a wind resistance when the covering flame is disrupted by the wind or a breeze. The systems of the invention having a wick and or wick sheath with a diameter of 2 inches or greater have withstood 30-40 mile per hour winds without the flame being extinguished.

In some embodiments, the wick is non-consumable and has a thickness of about 1/16 inch. The wick sits against the inner wall of the wick sheath and thereby creates the burn chamber within the exposed center, lined by the wick. The wick sheath is perforated aluminum with 0.0625 inch holes near the top of the wick sheath. The wick top is patterned to offer a natural ignition point. The height of the wick sheath is about 50-66% of the wick sheath diameter. The wick may be composed of FiberFrax® ceramic paper. In this embodiment, the burner system scales well from indoor candle to table-top burner to yard torch to fire pit.

The burning system can be refined or modified to accommodate a large variety of usage applications. The overall vertical height of the system can be extended verticality to showcase the flame or create a more vertical system, such as disclosed in FIG. 2 of U.S. patent application Ser. No. 13/640,482. A system with an extended vertical height may be suitable for outdoor applications where previously yard torches, such as TIKI torches, have been used. In some embodiments, the wick materials used can be of several natures and types including but not limited to ceramic, fiberglass, porous rock, porous metal, or any other kind of refractory product like papers, felts, blankets, tissues, and mats. The thickness of the wick may be of any thickness suitable to the desired application. The burner chamber geometries can be widely varied including but not limited to cylindrical, box, oval, spiral, paired linear, bracketed, among others as shown in FIGS. 18-22. The wick system can be paired with a melting plate or a melting grate, such as melting grate 140 to facilitate heat transfer. The wick system can be used with a solid fuel (blocked, carved, shaved, pelleted, or granular), such as fuel 201, or a lower volatile liquid fuel (like olive oil), or a fuel formulated with a volatile active ingredient including but not limited to fragrance, insect repellent, medicinal active, or other ingredient. The wick material or mass can be continuous, non-continuous, or perforated. The non-continuous or perforated wicks allow additional heat transfer through the wick. For example, the wick 130 shown in FIG. 3 has a vertical separation 137 along its entire height.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A fuel for a fuel burning system having a wick, the fuel comprising:

a body comprising wax, a priming protruding portion, a front wall, a bottom wall, and a spacing arm configured to space the body from a wick;

the priming protruding portion is vertically spaced from the bottom wall and extends beyond the front wall to create an overhang, the priming protruding portion extends along less than an entire horizontal width of the front wall;

the spacing arm comprises an exposed terminal contact end, the spacing arm extends beyond the front wall and terminates at the exposed terminal contact end, the spacing arm is located below the priming protruding portion, the priming protruding portion extends beyond the terminal contact end of the spacing arm;

the front wall comprises a lower front wall portion, the lower front wall portion is recessed from a portion of the front wall adjacent to the priming protruding portion;

the body comprises a priming wax flow path and a stoking wax flow path, the priming wax flow path extends along the priming protruding portion to a terminal end of the protruding portion at the overhang, the stoking wax flow path extends along the front wall toward the bottom wall.

2. The fuel of claim 1, wherein the body comprises at least one of a fragrance, an insect repellent, or a medicinal ingredient.

3. The fuel of claim 1, wherein the body comprises a stoking section adjacent a main section, the stoking section has a mass that is less than a mass of the main section, the priming protruding portion has a mass that is less than the mass of the stoking section and less than the mass of the main section.

4. A fuel burning system comprising:

a melted wax reservoir;

a meltable fuel comprising a main body, a priming protruding portion, a front wall, a bottom wall, and a spacing arm configured to space the main body from a wick;

the priming protruding portion is vertically spaced from the bottom wall and extends beyond the front wall to create an overhang, the priming protruding portion extends along less than an entire horizontal width of the front wall;

the spacing arm comprises an exposed terminal contact end adjacent the wick, the spacing arm extends beyond the front wall and terminates at the exposed terminal contact end, the spacing arm is located below the priming protruding portion, the priming protruding portion extends beyond the terminal contact end of the spacing arm;

the front wall comprises a lower front wall portion, the lower front wall portion is recessed from a portion of the front wall adjacent to the priming protruding portion;

the fuel comprises a priming wax flow path and a stoking wax flow path, the priming wax flow path extends along the priming protruding portion to a terminal end of the priming protruding portion at the overhang, the stoking wax flow path extends along the front wall toward the bottom wall;

a melting grate configured to support the fuel, the melting grate located above the melted wax reservoir so that the fuel melted on the melting grate can be received into the melted wax reservoir;

the wick comprising an at least partially hollow core extending above the melting grate, the fuel positionable so that the overhang is located over or adjacent to a top of the wick.

5. The fuel of claim 1, wherein the body has a center of gravity biased in a direction of the front wall.

6. The fuel of claim 1, wherein the lower front wall portion comprises a lower rearward sloping section adjacent the bottom wall, and the stoking wax flow path extends into the lower rearward sloping section.

7. The fuel of claim 1, wherein the spacing arm is a first spacing arm; and, the body comprises a second spacing arm, the first and second spacing arms are located adjacent to the bottom wall and extending beyond the lower front wall portion, each of the first and second spacing arms are laterally spaced from the other of the first or second spacing arms to form a wax pool open space between the spacing arms and the lower front wall portion;

the body comprises a second protruding portion each extending from the front wall, the priming protruding portion extends forward beyond the second protruding portion, the priming protruding portion is above the second protruding portion;

the spacing arms are located below the priming protruding portion; and, the stoking wax flow path extends to the wax pool open space.

8. The fuel of claim 7, wherein the body comprises a set of triangularly arranged contact locations comprising the second protruding portion and the first and second spacing arms;

the body comprises a back wall opposite the front wall, the back wall is radially curved.

9. The fuel of claim 1, wherein the spacing arm is spaced apart from the priming protruding portion.

10. The fuel of claim 3, wherein the priming protruding portion is configured to prime ignition of an at least partially hollow core wick, the stoking section is configured to stoke a flame, and the main section is configured to maintain the flame until substantially all of the fuel is consumed.

11. The fuel of claim 1, wherein the priming protruding portion comprises a mass to support ignition and fuel a flame on the wick when an ignition source is removed from the wick at least until initial melting of a stoking section of the body.

12. The fuel of claim 11, wherein the mass of the priming protruding portion is of 0.5 grams or less.

13. The fuel of claim 1, wherein the body comprises a stoking section, the stoking section comprises a mass sized to fuel a flame as the flame develops on the wick and as an operating temperature of a wick assembly is elevated by the flame above a melting temperature of a main section of the fuel.

14. The fuel of claim 13, wherein the mass of the stoking section is greater than 0.24 grams and less than 3 grams.

15. The system of claim 4, wherein the spacing arm is a first spacing arm;

the fuel comprises a second spacing arm, the first and second spacing arms are located adjacent to the bottom wall and extending beyond the lower front wall portion, each of the first and second spacing arms are laterally spaced from the other of the first or second spacing arms to form a wax pool open space between the spacing arms and the lower front wall portion;

the fuel comprises a second protruding portion each extending from the front wall, the priming protruding portion extends forward beyond the second protruding portion, the priming protruding portion is above the second protruding portion;

the spacing arms are located below the priming protruding portion;

the stoking wax flow path extends to the wax pool open space; and, the fuel comprises a set of triangularly arranged contact locations, for positioning the fuel relative to the wick, comprising the second protruding portion and the first and second spacing arms.

16. The fuel of claim 5, wherein the body comprises an angle of list greater than zero degrees and less than or equal to 30 degrees.

17. The fuel of claim 4, comprising a wick sheath surrounding the wick, the exposed terminal contact end of the spacing arm is in contact with the wick sheath.

18. The fuel of claim 1, the spacing arm is a first spacing arm; the body comprises a second spacing arm; the second spacing arm extends beyond the front wall and terminates at a second exposed terminal contact end of the second spacing arm, the second spacing arm is located below the priming protruding portion, the priming protruding portion extends beyond the second exposed terminal contact end of the second spacing arm.

19. The system of claim 4, wherein the fuel comprises a center of gravity biased toward the wick.

* * * * *